US006568779B1

(12) United States Patent
Pulman et al.

(10) Patent No.: US 6,568,779 B1
(45) Date of Patent: May 27, 2003

(54) OPERATION OF DROPLET DEPOSITION APPARATUS

(75) Inventors: Robert Mark Pulman, Saffron Walden (GB); Stephen Temple, Cambridge (GB); Laura Ann Webb, Cambridge (GB)

(73) Assignee: XAAR Technology Limited, Cambridge (GB)

( * ) Notice: Subject to any disclaimer, the term of this patent is extended or adjusted under 35 U.S.C. 154(b) by 0 days.

(21) Appl. No.: 09/151,461

(22) Filed: Sep. 11, 1998

Related U.S. Application Data

(63) Continuation of application No. PCT/GB97/00733, filed on Mar. 17, 1997.

(30) Foreign Application Priority Data

Mar. 15, 1996 (GB) ..... 9605547

(51) Int. Cl.[7] ..... B41J 29/38
(52) U.S. Cl. ..... 347/10
(58) Field of Search ..... 347/10–14

(56) References Cited

U.S. PATENT DOCUMENTS

| | | | | |
|---|---|---|---|---|
| 4,266,232 A | | 5/1981 | Juliana, Jr. et al. | |
| 4,409,596 A | | 10/1983 | Ishii | |
| 4,492,968 A | | 1/1985 | Lee et al. | |
| 4,973,980 A | | 11/1990 | Howkins et al. | |
| 5,168,284 A | | 12/1992 | Yeung | |
| 5,329,293 A | | 7/1994 | Liker | 347/11 |
| 5,477,243 A | | 12/1995 | Tamura | 347/12 |
| 5,541,628 A | | 7/1996 | Chang et al. | 347/10 |
| 5,581,281 A | | 12/1996 | Fuse | 347/14 |
| 5,600,349 A | | 2/1997 | Keefe | 347/11 |
| 5,631,675 A | | 5/1997 | Futagawa | 347/10 |
| 5,635,964 A | | 6/1997 | Burr et al. | 347/17 |
| 5,673,069 A | | 9/1997 | Canfield et al. | 347/15 |
| 5,673,071 A | | 9/1997 | Fuse | 347/35 |
| 5,894,314 A | * | 4/1999 | Tajika et al. | 347/14 |

FOREIGN PATENT DOCUMENTS

| | | | | |
|---|---|---|---|---|
| EP | 0 271 905 A2 | | 6/1988 | |
| EP | 0 390 202 B1 | | 10/1990 | |
| EP | 0 511 602 A1 | | 11/1992 | |
| EP | 0 627 313 A2 | | 12/1994 | |
| EP | 0 650 836 A2 | | 5/1995 | |
| EP | 0 654 351 A2 | | 5/1995 | |
| EP | 0 658 429 a2 | | 6/1995 | |
| EP | 0 700 790 A2 | | 3/1996 | |
| EP | 0 700 790 A3 | | 6/1996 | |
| EP | 0 761 440 A2 | | 3/1997 | |
| EP | 0 788 882 A2 | | 8/1997 | |
| JP | 57087371 A | | 5/1982 | B41J/3/04 |
| JP | 05116283 | | 5/1993 | |
| JP | 9-11479 | * | 1/1997 | |

OTHER PUBLICATIONS

English language abstract of Japanese Patent No. JP 57087371 A.

* cited by examiner

*Primary Examiner*—Benjamin R. Fuller
*Assistant Examiner*—Charlene Dickens
(74) *Attorney, Agent, or Firm*—Marshall, Gerstein & Borun

(57) ABSTRACT

In droplet deposition apparatus comprising one or more independently actuable ink ejection chambers, electrical signals are applied to reduce variation in the temperature of the droplet fluid between chambers and with variations in droplet ejection input data. Short potential difference pulses, suitable for influencing the temperature of the droplet fluid in a chamber, can be generated by application of longer duration voltages to ink chamber actuation means.

42 Claims, 19 Drawing Sheets

OPERATION OF DROPLET DEPOSITION APPARATUS

This is a 371 application continuation of International Application No. PCT/GB97/00733 filed Mar. 17, 1997, the entire disclosure of which is incorporated by reference.

BACKGROUND OF THE INVENTION

The present invention relates to methods of operation of droplet deposition apparatus, particularly inkjet printheads, comprising a chamber supplied with droplet fluid and communicating with a nozzle for ejection of droplets therefrom; and means actuable by electrical signals to vary the volume of said chamber, volume variation sufficient to effect droplet ejection being effected in accordance with droplet ejection input data.

DESCRIPTION OF RELATED ART

Apparatus of this kind is well known in the art. EP-A-0 364 136 shows a printhead formed with a number of ink channels bounded on both sides by piezoelectric side walls which deflect in the direction of an electric field applied by electrodes on the wall surfaces, thereby to reduce the volume of the ink channel and eject a droplet from an associated nozzle.

Unlike 'thermal' printheads in which each ink channel is provided with a heater that can be actuated so as to generate a bubble of vapour which pushes ink out of the channel via an associated nozzle, there is no need for 'variable volume chamber' printheads of the kind described above to heat the ink in the channel.

However, the present inventors have discovered that heating of ink in the chambers of a 'variable volume chamber' printhead can take place, particularly when it is operated at high frequency. FIG. 1 of the accompanying drawings is a plot of droplet ejection velocity U against the amplitude V of the electrical signal applied to the piezoelectric side walls of a channel in a printhead of the kind shown in the aforementioned EP-A-0 364 136. Plot A corresponds to a droplet ejection rate of one drop every droplet ejection period, with each droplet ejection period lasting 0.25 milliseconds, whilst plot B corresponds to a droplet ejection rate of one drop every 66 droplet ejection periods. It will be seen that for a given amplitude V of the electrical signal, a significantly faster droplet will be ejected by the printhead when operating at the higher ejection rate than at the lower ejection rate. Such a velocity increase is attributable to a decrease in viscous losses during the droplet ejection process due to a reduction in the viscosity of the ink. This in turn is the result of an increase in the temperature of the ink between the two operating conditions A and B caused by the heating of ink in the channel which, it is believed, is due to inefficiencies in the printhead.

It will be appreciated that droplet ejection velocity has to be taken into account when synchronising droplet ejection from the printhead with the movement of the substrate relative to the printhead and that any variation in velocity will manifest itself as droplet placement errors in the final print For example, the drop placement tolerance is frequently specified as one quarter of a drop pitch. Thus for a print matrix density of 360 dots per inch, the drop placement tolerance will be $\Delta X=18\ \mu m$. The variation in droplet ejection velocity, $\Delta U$ is related to the dot placement tolerance by the formula $$\Delta U=U_d^2.\Delta X/h.U_h$$

where h is the flight path length (typically 1.0 mm), Uh is the printhead velocity relative to the print substrate (typically 0.7 $ms^{-1}$) and Ud is the mean droplet ejection velocity.

For mean droplet ejection velocities of 5,10 and 15 $ms^{-1}$, the maximum acceptable variation in droplet ejection velocity is 0.65, 2.6 and 5.8 $ms^{-1}$ respectively. Thus there is a substantially greater allowable tolerance in the drop velocity when the mean droplet ejection velocity takes a value greater than 5 $ms^{-1}$.

On the other hand, there is maximum droplet ejection velocity ('threshold velocity'), $U_{thr}$, which corresponds to the onset of capillary instability. In variable-volume (piezoelectric) printers, the inventors have found $U_{thr}$ to be usually in the range 12–15 $ms^{-1}$ when continuous high frequency droplet ejection is sustained, although higher droplet ejection velocities can be obtained during short bursts of drop formation.

It will also be appreciated that the rate at which a particular chamber in a printhead is actuated will depend on the incoming droplet ejection input data (which will be determined, by the image to be printed and generally vary from high to low). Thus in a printhead having a chamber operating in accordance with FIG. 1 and at a given amplitude—for example 35—of electrical signal V, droplet ejection input data causing the chamber to eject droplets frequently (equivalent to plot A) will result in a droplet velocity of 15 m/s whilst subsequent input data may only cause the chamber to eject droplets at a lower rate (equivalent to plot B) and consequently at a much reduced velocity of 2 m/s. Such a large (750%) variation in ejection velocity will clearly lead to inaccuracies in the placement of the droplets and a reduction in the quality of the printed image. Such an error may occur for every chamber in a multi-chamber printhead. The degree of difference between these two conditions increases with ink viscosity and also with operating frequency, making the control of this effect particularly important in high speed printers.

It will also be evident from FIG. 1 that there is only a narrow range of magnitude V of actuation waveform—denoted W—over which droplet ejection at both high and low rates can be guaranteed. This in turn severely inhibits the operational flexibility of the printhead.

SUMMARY OF THE INVENTION

According to one aspect of the present invention, these problems are solved at least in preferred embodiments by a method of operation of droplet deposition apparatus comprising a chamber supplied with droplet fluid and communicating with a nozzle for ejection of droplets therefrom; and actuator means actuable by electrical signals to vary the volume of said chamber; volume variation sufficient to effect droplet ejection being effected in accordance with droplet ejection input data; the method comprising the steps of controlling said electrical signals such that the temperature of the droplet fluid in said chamber remains substantially independent of variations in the droplet ejection input data.

Such a method can avoid velocity variations between enabled channels due to variations in ink viscosity which in turn are attributable to temperature variants caused by differential actuation rates. Differential actuation rates are of course a result of differences in the droplet ejection input data between enabled channels.

This aspect of the present invention also comprises the method of operation of droplet deposition apparatus comprising first and second chambers each supplied with droplet fluid and communicating with a nozzle for ejection of droplets therefrom and having actuator means actuable by electrical signals to effect droplet ejection selectively from said chambers in accordance with droplet ejection input data; the method comprising operating said actuator means to effect droplet ejection from the first chamber but not from the second chamber, and selectively electrically heating the fluid in the second chamber to reduce the difference in temperature between fluid in the second chamber and fluid in the first chamber.

Again, by reducing variation in the temperature of the droplet fluid between first and second chamber, viscosity-related droplet ejection speed differences can be reduced.

Thus again according to the invention there is provided a method of operation of droplet deposition apparatus comprising a chamber supplied with droplet fluid and communicating with a nozzle for ejection of droplets therefrom; and actuator means actuable by electrical signals to effect droplet ejection from the chamber in accordance with droplet ejection input data; the method comprising controlling said electrical signals such that the maximum droplet ejection velocity lies just below a threshold velocity ($U_{thr}$), as hereinbefore defined and the variation in the droplet ejection velocity due to variations in the temperature of the droplet fluid in said chamber lies within a range determined by constraints in drop landing position.

According to another aspect of the present invention there is provided a method of operation of droplet deposition apparatus comprising a chamber supplied with droplet fluid, a nozzle communicating with the channel for ejection of droplets therefrom and actuator means having first and second electrodes and actuable by a potential difference applied across first and second electrodes to effect droplet ejection from the chamber via the nozzle;

the method comprising the steps of applying to the first electrode a first non-zero voltage signal for a first duration, applying to the second electrode a second non-zero voltage signal for a second duration, the first and second voltage signals being applied simultaneously for a length of time less than at least one of said first and second durations.

This second aspect allows short potential pulses to be generated using voltage waveforms that are of longer duration and thus simpler to generate, not requiring complex and expensive circuitry. Such short pulses, whilst generally applicable in printhead operation, are of particular use when implementing the other aspects of the invention described above.

The novel principle of selectively electrically heating non-firing (drop ejecting) chambers in a droplet deposition apparatus to reduce temperature variations between the fluid in different chambers is applicable to any such apparatus regardless of the mechanism by which the chambers are fired.

Thus in another aspect the invention provides a method of operation of droplet deposition apparatus comprising a chamber supplied with droplet fluid and communicating with a nozzle for ejection of droplets therefrom; and actuator means actuable by electrical signals to effect droplet ejection in accordance with droplet ejection input data; the method comprising the steps of controlling said electrical signals such that the temperature of the droplet fluid in said chamber remains substantially independent of variations in the droplet ejection input data.

According to another aspect of the invention there is provided a method of operation of droplet deposition apparatus comprising a chamber supplied with droplet fluid and communicating with a nozzle for ejection of droplets therefrom; and actuator means actuable by electrical signals to vary the volume of said chamber, volume variation sufficient to effect droplet ejection being effected in accordance with droplet ejection input data; the method comprising applying electrical signals so as to actuate said actuator means without effecting droplet ejection from said nozzle, the electrical signals being controlled in dependence on a further signal representative of temperature.

Such a method in preferred embodiments may facilitate more sophisticated control of the temperature of the droplet deposition fluid.

The present invention also comprises signal processing means configured for carrying out the aforementioned methods and droplet deposition apparatus incorporating such signal processing means.

Preferred features and embodiments of the present invention are set out in the subordinate claims and the description that follows.

BRIEF DESCRIPTION OF THE DRAWINGS

The invention will now be described by way of example only by reference to the remainder of the accompanying drawings, in which.

DETAILED DESCRIPTION OF THE INVENTION

Figure 2:
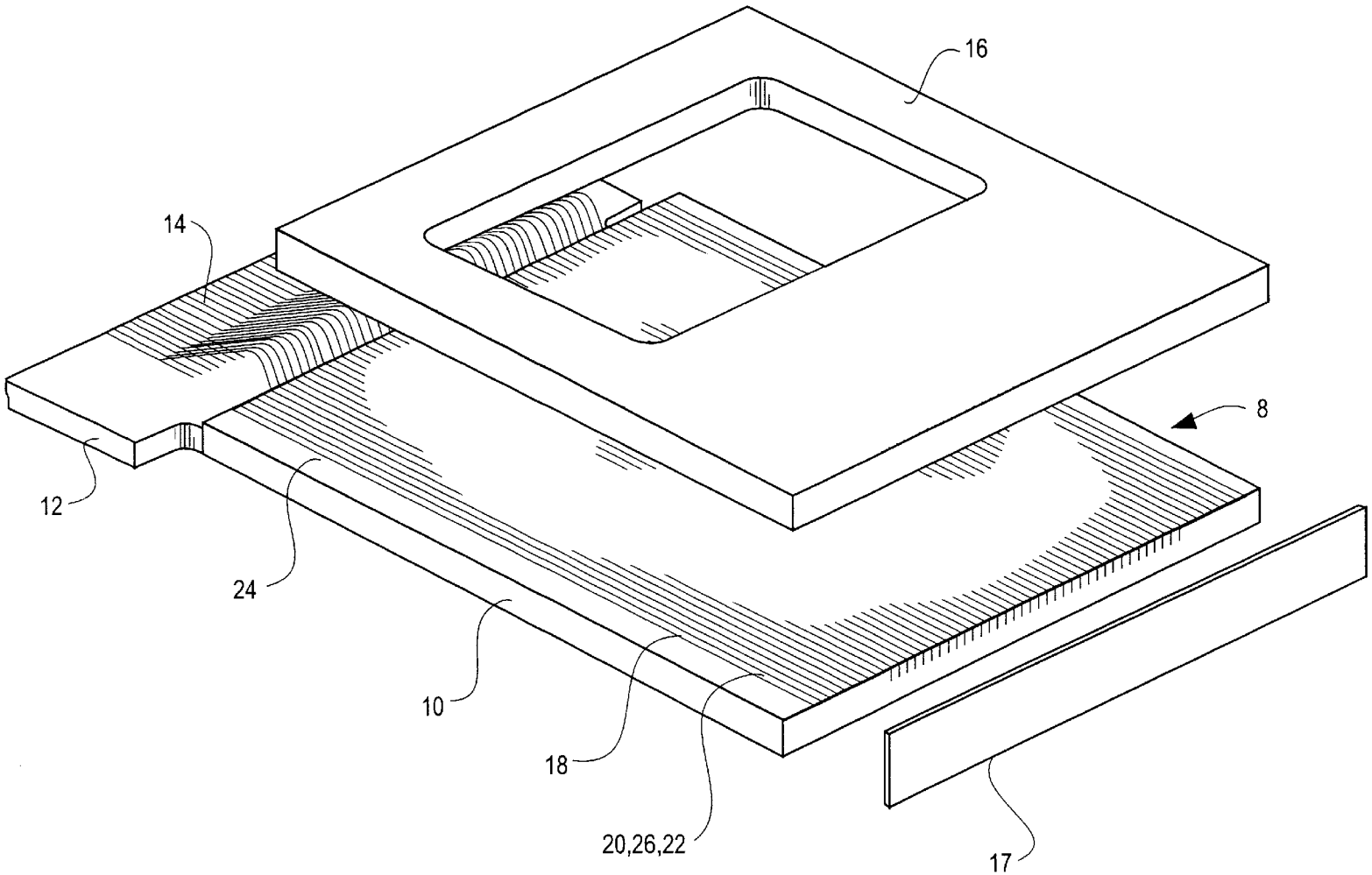
FIG. 2 illustrates a perspective exploded view of one form of ink jet printhead incorporating piezoelectric wall actuators operating in shear mode and comprising a printhead base, a cover and a nozzle plate.

FIG. 2 shows an exploded view in perspective of a typical ink jet printhead 8 incorporating piezoelectric wall actuators operating in shear mode. It comprises a base 10 of piezoelectric material mounted on a circuit board 12 of which only a section showing connection tracks 14 is illustrated. A cover 16, which is bonded during assembly to the base 10, is shown above its assembled location. A nozzle plate 17 is also shown adjacent the printhead base.

A multiplicity of parallel grooves 18 are formed in the base 10 extending into the layer of piezoelectric material. The grooves are formed as described, for example, in the aforementioned EP-A-0 364 136 and comprise a forward part in which the grooves are comparatively deep to provide ink channels 20 separated by opposing actuator walls 22. The grooves in the rearward part are comparatively shallow to provide locations for connection tracks. After forming the grooves 18, metallized plating is deposited in the forward part providing electrodes 26 on the opposing faces of the ink channels 20 where it extends approximately one half of the channel height from the tops of the walls and in the rearward part is deposited providing connection tracks 24 connected to the electrodes in each channel 20. The tops of the walls are kept free of plating metal so that the track 24 and the electrodes 26 form isolated actuating electrodes for each channel. The base 10 may thereafter be coated with a passivant layer for electrical isolation of the electrode parts from the ink.

Subsequently, the base 10 is mounted as shown in FIG. 2 on the circuit board 12 and bonded wire connections are made connecting the connection tracks 24 on the base 10 to the connection tracks 14 on the circuit board 12.

Figure 3:
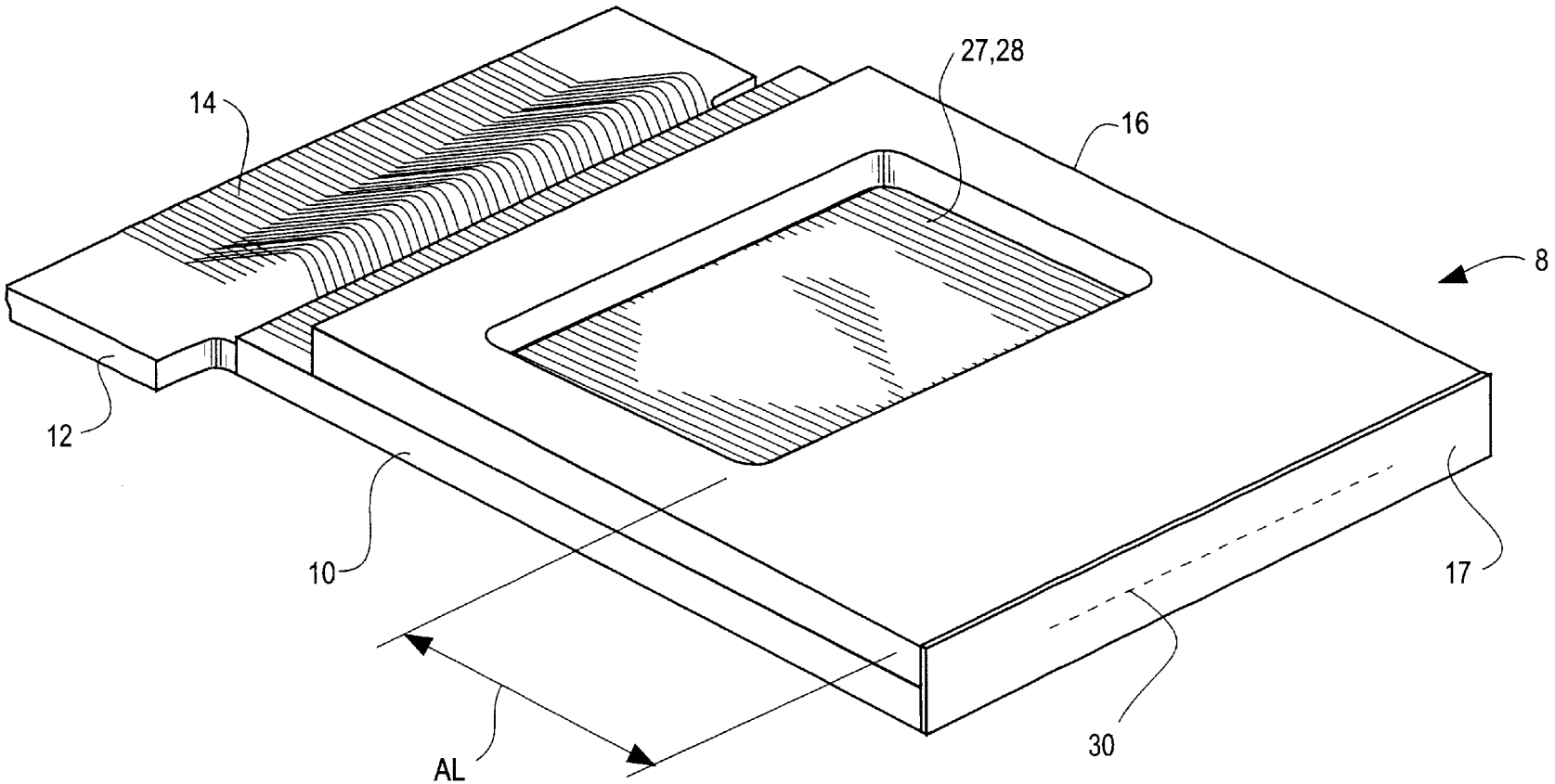
FIG. 3 illustrates the printhead of FIG. 2 in perspective after assembly.

The ink jet printhead 8 is illustrated after assembly in FIG. 3. In the assembled printhead, the cover 16 is secured by bonding to the tops of the actuator walls 22 thereby forming a multiplicity of closed channels 20 having access at one end to the window 27 in the cover 16 which provides a manifold 28 for the supply of replenishment ink. The nozzle plate 17 is attached by bonding at the other end of the ink channels. The nozzles 30 are formed by UV excimer laser ablation at locations in the nozzle plate corresponding with each channel.

Figure 4:
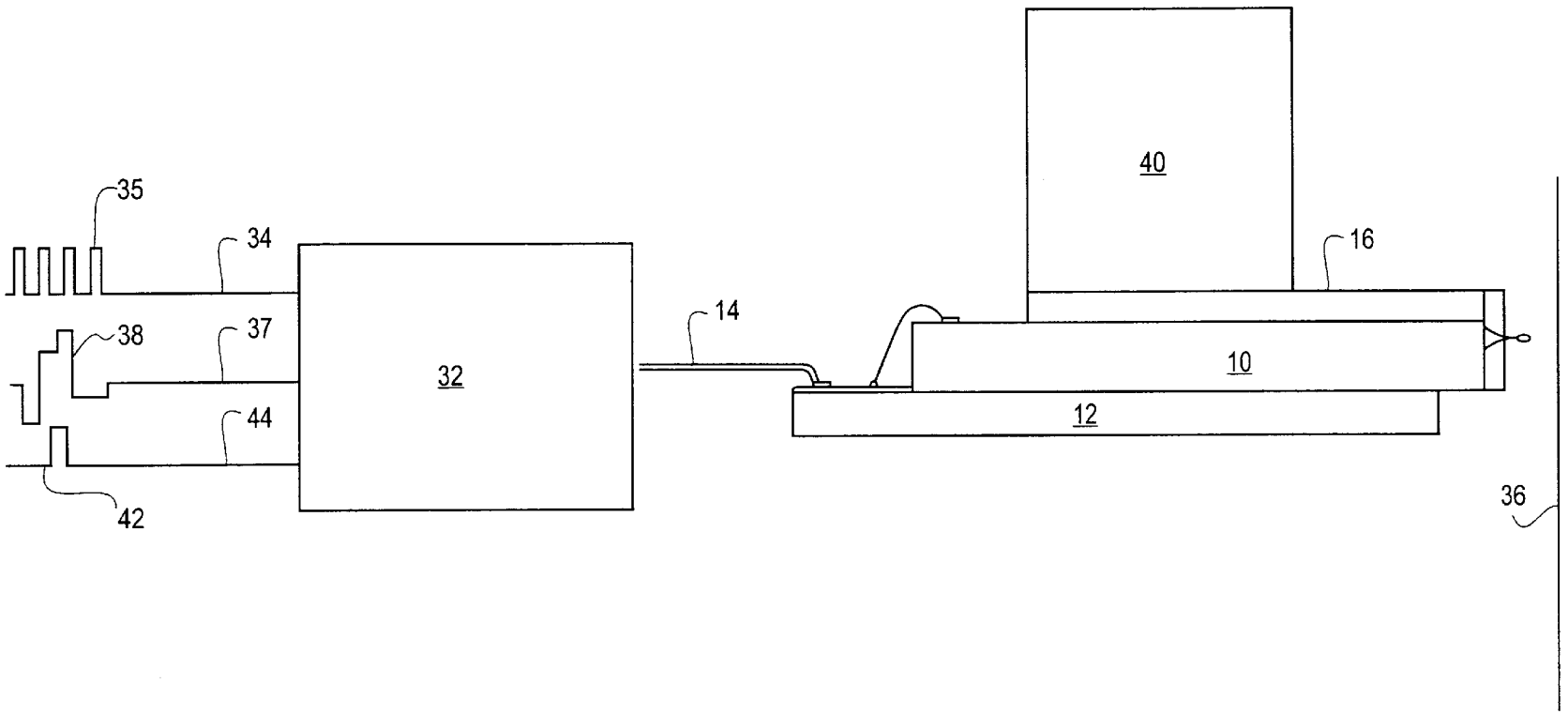
FIG. 4 illustrates a drive circuit connected via connection tracks to the printhead to which are applied a drive voltage waveform, timing signals and droplet ejection input data for the selection of ink channels, so that on application of the waveform, drops are ejected from the channels selected.

The printhead is operated by delivering ink from an ink cartridge via the ink manifold 28, from where it is drawn into the ink channels to the nozzles 30. The drive circuit 32 connected to the printhead is illustrated in FIG. 4. In one form it is an external circuit connected to the connection tracks 14, but in an alternative embodiment (not shown) an integrated circuit chip may be mounted on the printhead. The drive circuit 32 is operated by applying (via a data link 34) input data 35 defining locations in each print line at which printing—i.e. droplet ejection—is to take place as the printhead is scanned over a print surface 36. Further, a voltage waveform signal 38 for channel actuation is applied via the signal link 37. Finally, a clock pulse 42 is applied via a timing link 44.

As is known, e.g. from EP-A-0 277 703, appropriate application of voltage waveforms to the electrodes on either side of a channel wall will result in a potential difference being set up across the wall which in turn will cause the poled piezoelectric material of the channel walls to deform in shear mode and the wall to deflect transversely relative to the respective channel. One or both of the walls bounding an ink channel can be thus deflected—movement into the channel decreasing the channel volume, movement out of the channel increasing the channel volume—thereby to establish pressure waves in the ink along the closed length of each channel, also known as the 'active length' of the channel and denoted in FIG. 2 by 'AL'. The pressure waves cause a droplet of ink to be expelled from the nozzle.

It should be noted that in constructions of the type shown in FIGS. 2 to 4, it is usually convenient for connections to be made between the wall electrodes internally to provide one electrode per channel: when a voltage waveform signal is applied to the electrode corresponding to a channel and a datum voltage waveform is applied to the electrodes of the neighbouring channels (both controlled by the drive circuit 32 in response to droplet ejection input data), the resulting potential differences across the walls adjacent the channel then effect displacements of each wall causing the volume and pressure in the ink in each channel to be either increased or decreased. Regardless of whether the connections are made internally or externally of the printhead, it is then convenient to describe the actuating waveform as being applied "to a selected channel". In the waveform representations in the Figures that follow, a positive signal would result in the walls bounding a channel moving outwardly from the channel i.e. to cause an increase in the volume of the channel.

Figure 5A:
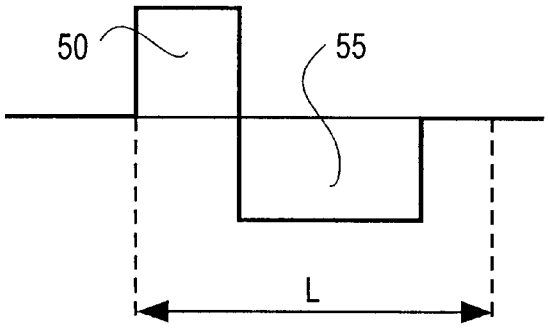
FIGS. 5(*a*) and (*b*) show waveforms according to one embodiment of the present invention.
Figure 5B:
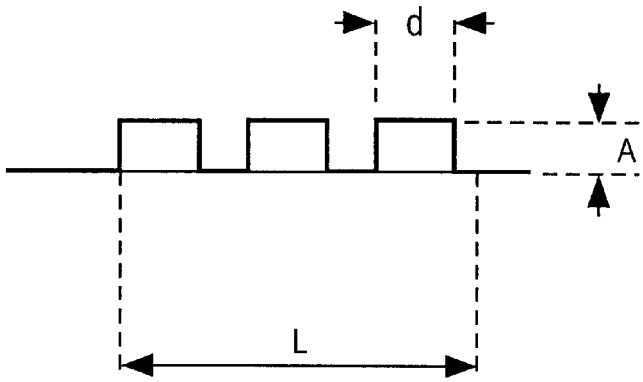

FIG. 5 shows actuation waveforms for operating an inkjet printhead in accordance with the present invention. FIG. 5(*a*) shows a voltage waveform of the 'draw-release-reinforce' type: part 50 of the signal causes an initial increase in the volume of the channel for a period of approximately AL/c (AL being the active length of the channel, c being the speed of pressure waves in the ink, 2AL/c being the period of oscillation of pressure waves in the ink in the channel), with subsequent part 55 decreasing the volume of the channel for a period of approximately 2AL/c to eject of a droplet from the nozzle. Waveforms of this genre have already been discussed in WO 95/25011. After completion of a droplet ejection period L, the length of which will be determined by a number of factors including the time taken for pressure waves in the chamber to die down, the actuation waveform can be applied again to effect ejection of another droplet.

In printheads of the kind described above, it is believed that a significant cause of heating of the ink is the transmission to the ink of heat generated by hysteresis in the piezoelectric material when subjected to step changes in the applied potential difference. Print data requiring frequent firing of a channel will result in greater number of hysteresis cycles in the respective actuators, resulting in the generation of significant amounts of heat, much of which will be transferred to the ink, raising its temperature and reducing its viscosity. In contrast, in those channels which—due to the incoming print data—are fired less frequently, there will be less heat generation, less warming of the ink and therefore less reduction in ink viscosity. Heat will of course be carried away from the channel by the drops that are ejected, with frequently firing channels losing a greater amount of heat than less frequently firing channels. Heat will also be lost from the printhead as a whole due to convection and radiation. Nevertheless, it has been found that the net energy input is greater in frequently firing channels than in less frequently firing channels, giving rise to a variation in droplet ejection velocity between channels which may manifest itself as droplet placement errors on the printed page.

A solution to this problem according to one embodiment of the invention involves the application of a first drop-ejecting actuation waveform—which may well be known in the art per se—to the selected channel when required to fire in accordance with the print data, and applying a second waveform to the channel when required not to fire by the print data, one or both of the waveforms being chosen such that the temperature change of the droplet fluid in said chamber when actuated with said first drop-ejecting actuation waveform is substantially equal to the temperature change of the droplet fluid in said chamber when actuated with said second drop-ejecting actuating waveform.

An example of a drop-ejecting waveform is illustrated in FIG. 5(*a*). An example of a corresponding, non-droplet ejecting waveform is shown in FIG. 5(*b*) and comprises a number n of square wave pulses of magnitude A and duration d spread over the same droplet ejection period of duration L as the drop-ejecting waveform. A combination of A, d and n are chosen so as (a) to cause a change in the temperature of the droplet fluid substantially equal to that caused by the drop-ejecting waveform, and (b) not to cause drop ejection.

A waveform meeting conditions (a) and (b) may be established by a simple process of trial and error, with parameters A, d and n being modified until a consistent drop ejection speed (and ink temperature) is achieved independent of the density of the firing signals applied to the chamber and actuation means.

Figure 1:
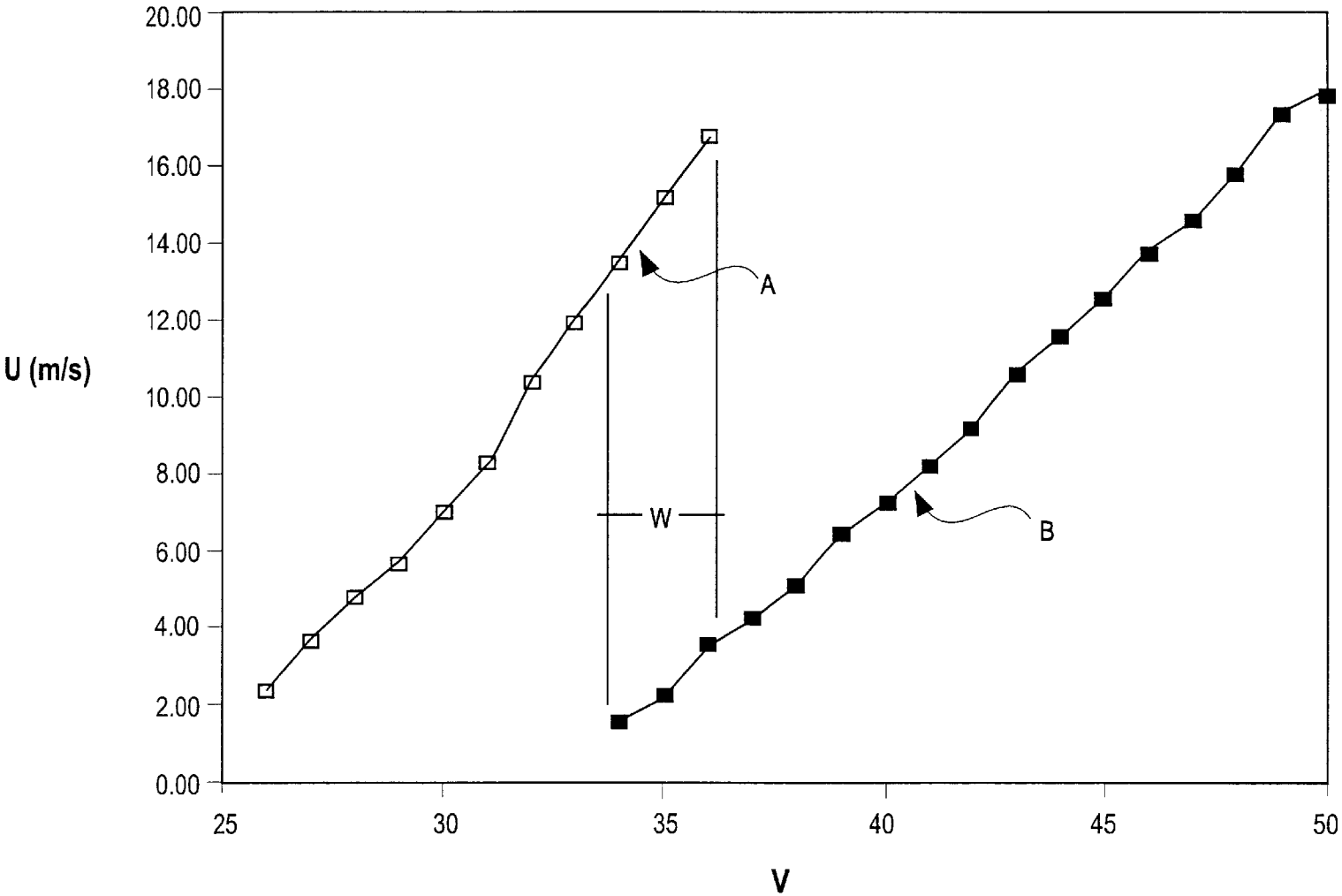
FIG. 1 illustrates a plot of droplet ejection velocity U against amplitude V of an electrical signal applied to piezoelectric side walls of a channel in a prior art printhead.
Figure 7:
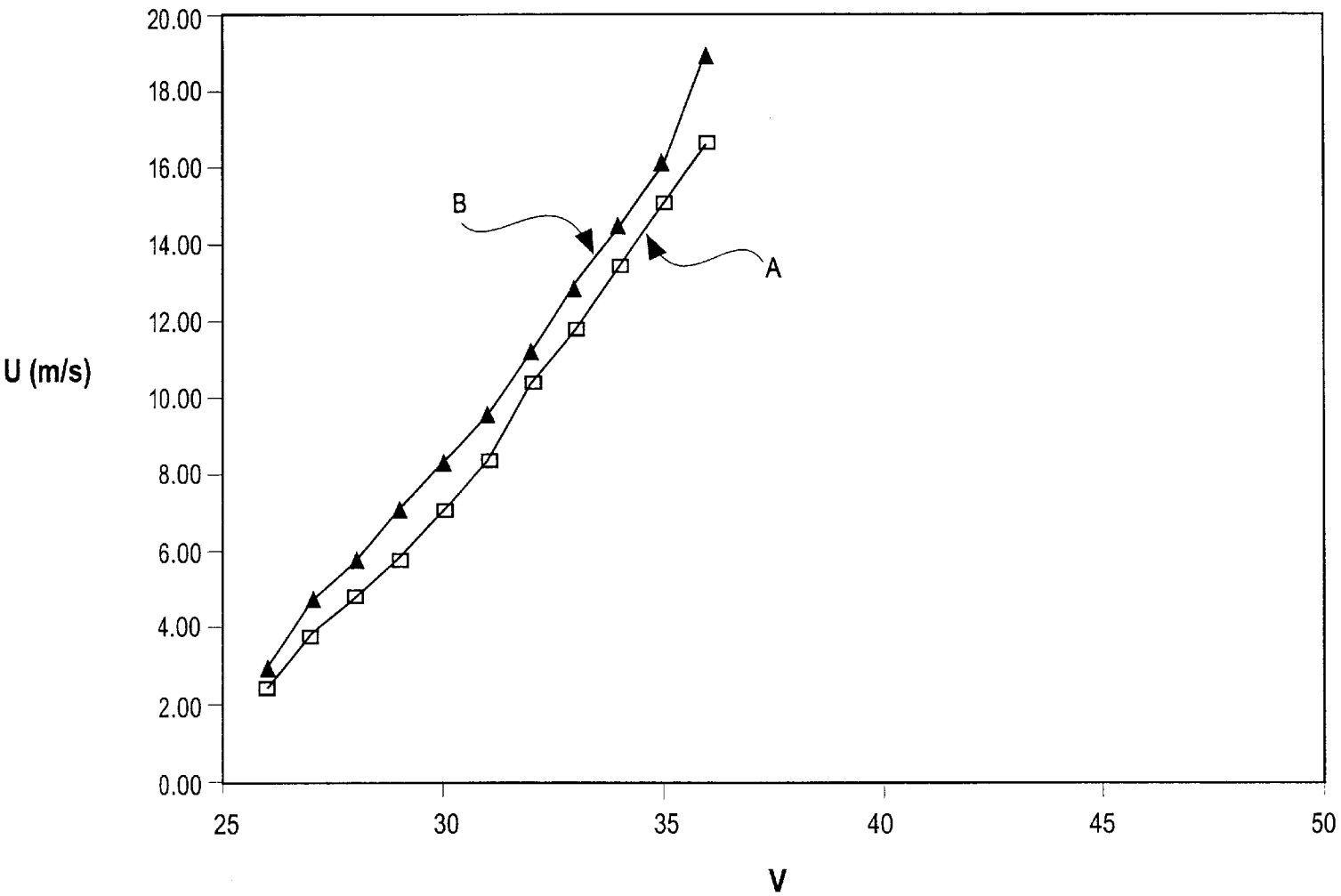
FIG. 7 illustrates the variation in droplet ejection velocity U with amplitude V of electrical signal applied to eject a droplet from a printhead operated in accordance with the present invention.

FIG. 7 illustrates the improvement in performance obtained with the present invention. Plot A is taken from FIG. 1 and shows the variation in droplet ejection velocity U with the magnitude V of the actuation waveform for a printhead of the kind shown in FIGS. 2 to 4 operating with the waveform of FIG. 5(*a*) and at a droplet ejection rate of one drop every droplet ejection period (0.25 milliseconds). Plot B' is the corresponding characteristic for the printhead operating at a droplet ejection rate of one drop every 66 droplet ejection periods but actuated with a non-ejecting waveform of the kind shown in FIG. 5(*b*) for each of the 65 intervening droplet ejection periods.

The two characteristics, A and B', are practically the same, indicating that the temperature of the ink in the channel is the same in both cases. There will consequently be negligible variation in droplet ejection velocity with droplet ejection rate i.e. with droplet ejection input data. It will also be clear that droplet ejection at both high and low rates is possible over practically the entire range of magnitudes V of the actuation waveform, enhancing the operational flexibility of the printhead.

Alternatively, approximate values for the parameters can be obtained by consideration of the piezoelectric actuator itself. As has been explained above, application of a voltage "to a selected channel" together with application of voltages to neighbouring channels results in changes in the potential difference across each of the walls bounding the selected channel. Each potential difference change induces a current flow that in turn is determined by the resistive and capacitive properties of the channel wall and driving circuitry. The electrodes on either side of a wall of piezoelectric material form a capacitor C whilst the electrodes themselves have resistance R. A loss tangent, tan δ, is also associated with the capacitor $C_1$ where C tan δ—which may be regarded as a parallel, non-linear resistor—represents hysteresis loss in the PZT in response to changes in the potential difference between the wall electrodes. Further resistance, also usually non-linear, is also associated with the drive circuit. Together, these can be treated as a lumped R-C network (although a distributed R-C-L network might be a more accurate model) and the current flow in response to a potential difference change calculated using established electrical principles. This is true not only of printhead of the kind shown in FIGS. 2 to 4 but of piezoelectric actuators in general and many other kinds of actuators.

Figure 6:
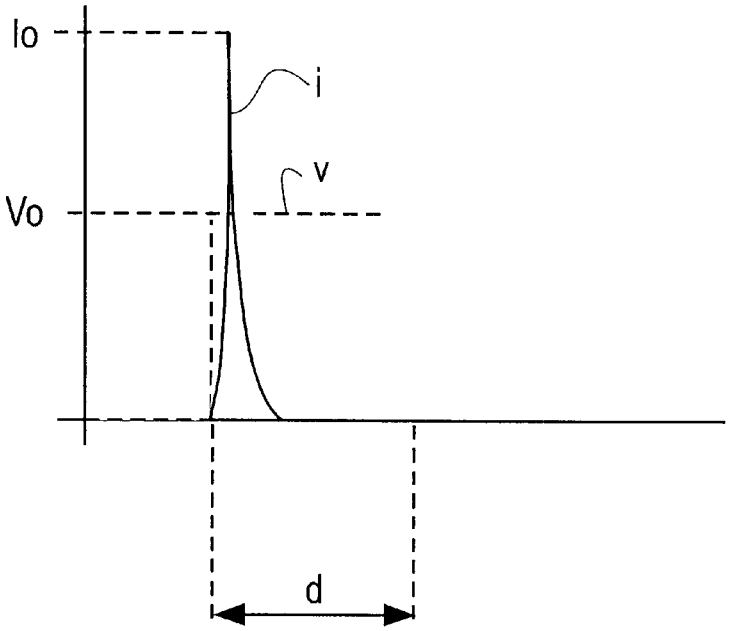
FIG. 6 illustrates the response of a piezoelectric actuator to a step voltage input.

When the actuator is subjected, for example, to a step change in potential difference as indicated by dashed line V in FIG. 6, current will flow in the circuitry associated with the actuator in an exponentially decaying manner (line i in FIG. 6) with the initial magnitude $I_0$ of the induced current being proportional to the magnitude $V_0$ of the voltage step and the decay rate being determined by the RC time constant of the circuit. The energy dissipated will be proportional to the integral of the square of the current flow which can be shown to be equal to an ohmic loss $0.5(CV_0^2)$ occurring in the resistive elements of the circuit. In addition, a hysteresis loss of $0.25.\pi.(CV_0^2)$. tan δ per step change is generated, where tan δ takes a value corresponding to the electric field in the piezoelectric wall. Therefore, a doubling of $V_0$ will result in a quadrupling of the area under the curve i, equating to a quadrupling of the energy dissipated, and if, for example, the magnitude of a voltage step in a non-drop ejecting actuation waveform were half that of an equivalent step of a drop ejecting actuation waveform, the energy dissipated by the former would be one quarter that of the latter. Hence four steps would be required in the non-drop ejecting actuation waveform to achieve the same energy dissipation as the drop ejecting actuation waveform.

In practice, less energy will be required because some heat is taken from the channel by the elected drop during firing whereas no such loss occurs during the non-ejecting pulses. In actuators of the kind described above, it has been found that over one half (approximately 60%) of the heat loss from a channel is by conduction through the body of the printhead, with the remainder (approximately 40%) being lost through droplet ejection. Thus in a non-ejecting channel, the electrical signal need only generate sufficient hysteresis loss to balance that energy lost through the body of the printhead.

It will be appreciated that waveforms such as that shown in FIG. 5(*a*) comprise a number of voltage steps (or "edges"), each of which will induce current flow and energy dissipation. All such steps need to be taken into account in the calculation for condition (a). It will further be understood that the quadratic relationship between dissipated energy and voltage step magnitude will not hold where current flow does not decay completely between successive voltage steps. Indeed, control of the time that elapses between successive steps in such a situation allows accurate control of the amount of energy dissipated. In such situations the power flow will have to be calculated by other methods as are well known.

Figure 8:
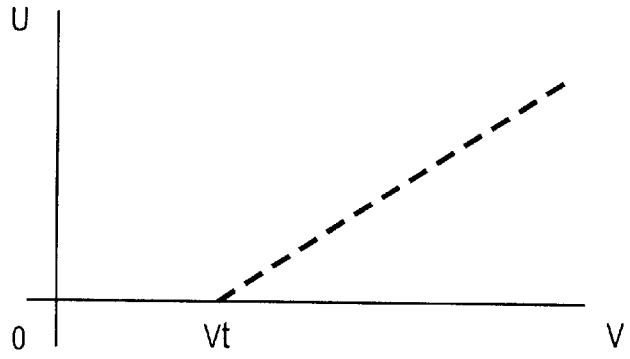
FIG. 8 shows the relationship between droplet ejection velocity U and actuation pulse magnitude for a typical printhead of the type shown in FIGS. 2 to 4.

As regards condition (b), the threshold value of pulse magnitude Vt below which droplet ejection will not occur can be determined empirically for any particular printhead design. FIG. 8 illustrates the relationship between droplet ejection velocity U and actuation voltage pulse amplitude for a typical printhead of the type shown in FIGS. 2 to 4.

Figure 9:
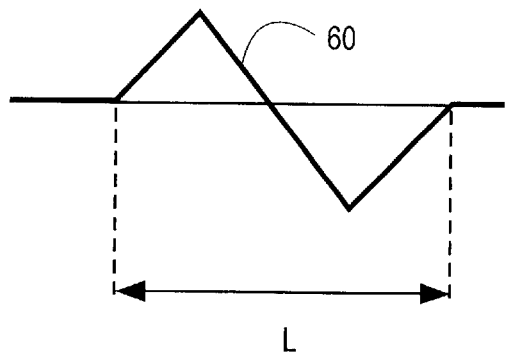
FIG. 9 is an embodiment of a non-droplet-ejecting actuating waveform in accordance with the present invention.

FIG. 9 shows a second form of non-firing actuating voltage suitable for use in conjunction with the drop ejecting waveform shown in FIG. 5(*a*). In contrast to the waveform of FIG. 5(*b*), it is the frequency content—rather than the amplitude—of the waveform that is chosen so as to avoid droplet ejection. Fourier analysis of the waveform of FIG. 8 incorporating ramp portions 60 would reveal a frequency spectrum deficient in those frequencies necessary to excite droplet ejection from the printhead. The amplitude and duration of such a ramp pulse could nevertheless be chosen so as to generate the same temperature change in the ink.

Figure 10:
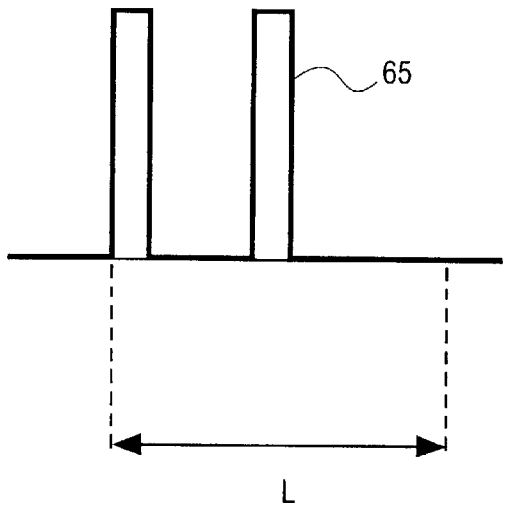
FIG. 10 is a further embodiment of a non-droplet-ejecting actuating waveform.

The same concept lies behind the waveform illustrated in FIG. 10: whilst the amplitude of the pulses 65 might be greater than the threshold voltage $V_t$ shown in FIG. 8, the overall frequency content of the waveform is such that it will not excite droplet ejection.

The principles described above are generally applicable to any droplet deposition apparatus comprising chamber, nozzle and piezoelectric actuator, particularly where a plurality of such elements are arranged into an array, the chambers being arranged in an array direction, as is well known in the art. However, the underlying problems—and thus the need for a solution—will be more acute in those devices wherein said piezoelectric material extends over the major part of a wall of said chamber, as described e.g. in U.S. Pat. No. s 4,584,590 and 4,825,227, and especially in printheads of the kind described with reference to FIGS. 2 to 4 in which the chamber is one of a plurality of channels formed in a base, walls being defined between said channels, with each wall comprising piezoelectric material actuable by means of electrical signals to deflect said wall relative to said channel, thereby to vary the volume of said channel.

Yet further refinements are possible when such methods of operation are to be applied to a "shared-wall" device of the kind shown, for example, in FIGS. 2 to 4 and in which it is not possible to simultaneously fire two adjacent channels separated by a shared actuating wall. Such devices are conveniently operated "multi-cycle" mode, whereby successive channels in the array are assigned to one of a plurality of groups in a regular manner and each group of channels is enabled for droplet ejection in successive droplet ejection periods. EP-A-0 278 590 discloses 'two-cycle' operation, where alternate channels are assigned to one of two groups and each groups of channels is enabled for droplet ejection in alternate droplet ejection periods. EP-A-0 376 532 describes the division of channels into three groups, with each channel of a particular group being separated by channels belonging to the other two groups, each group being enabled in turn whilst the other two groups remain disabled. Operation with more than three cycles is also possible.

In a corresponding embodiment of the present invention, it is only necessary to apply the droplet ejecting or non-ejecting waveforms in accordance with the print data to those channels belonging to the group enabled for droplet ejection at that time. Such waveforms will be referred to as 'enabled/ejecting' and 'enabled/non-ejecting' hereinafter.

Channels belonging to the remaining, disabled groups (of which there are two in the case of three-cycle operation) can remain inactive and, in the case of devices having electrodes in the channels as described above, this entails applying a common actuating signal to the channel electrodes of the disabled channels. As a result, no electric field will be set up across the wall which separates the two disabled channels and this will remain stationary. A channel (in this case the disabled channels) will not eject a droplet if one or both of its walls does not move. At the end of the period of enablement of the enabled channel group, one of the other channel groups may be enabled as is well known in the art. Such operation is disclosed in WO95/25011.

FIGS. 11 to 16 illustrate implementations of the above principles.

Figure 11:
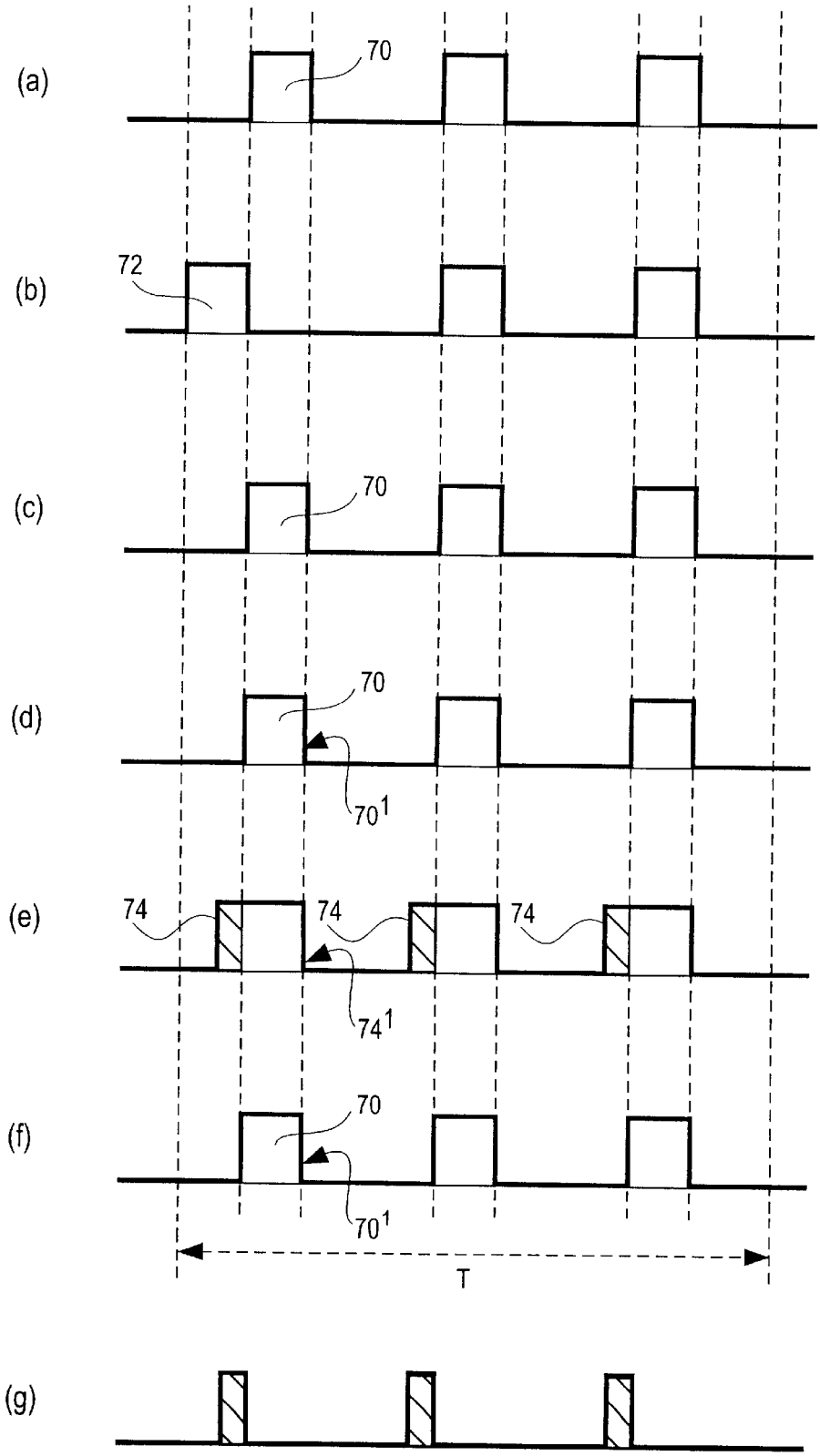
FIG. 11 shows the actuating voltage waveforms applied to six adjacent channels operating in "multi-cycle" mode in accordance with the present invention.

Lines (a)–(f) of FIG. 11 show the voltages applied to the electrodes of six adjacent channels (a)–(f) in a 'shared-wall' printhead. Successive channels are assigned to one of three groups in a regular manner such that channels (a) and (d) belong to a first group, channels (b) and (e) to a second group and channels (c) and (f) to a third group. In the example of FIG. 11, the second group is enabled (the first and third groups being disabled), with the droplet ejection input data being such that channel (b) of the second group is actuated to eject a droplet whilst channel (e) of the second group is not.

Application of voltage pulse 72 (the enabled/ejecting waveform) to enabled channel (b) followed by voltage pulses 70 to disabled channels (a) and (c) results in a 'draw-release-reinforce' potential difference of the kind shown in FIG. 5(*a*) across each of the walls bounding channel (b), causing them to move to eject a droplet from channel (b).

An enabled/non-ejecting waveform is applied to enabled channel (e). This comprises a plurality (three in the example shown) of pulses 74 each having the same amplitude as pulses 70 and each having a trailing edge 74 synchronous with the trailing edge 70 of the corresponding pulse 70 applied to the neighbouring channels. Pulses 74 are, however, of greater duration than pulses 70, resulting in a potential difference 76 of the kind shown in FIG. 11(*g*) being applied to each of the walls bounding channel (e). Whilst this potential difference will have the same amplitude as pulses 70,72, its duration is chosen to be insufficient to effect droplet ejection.

At the end of period $T_1$ the second channel group is disabled and one of the other groups is enabled for droplet ejection, as is well known in the art. Although the droplet ejection period T for a multi-channel arrangement should ideally be no longer than the droplet ejection period L of a single channel as mentioned above with reference to FIG. 5(*a*), T may need to be longer than the ideal if it is necessary to accommodate several non-drop-ejection pulses 74.

Figure 12:
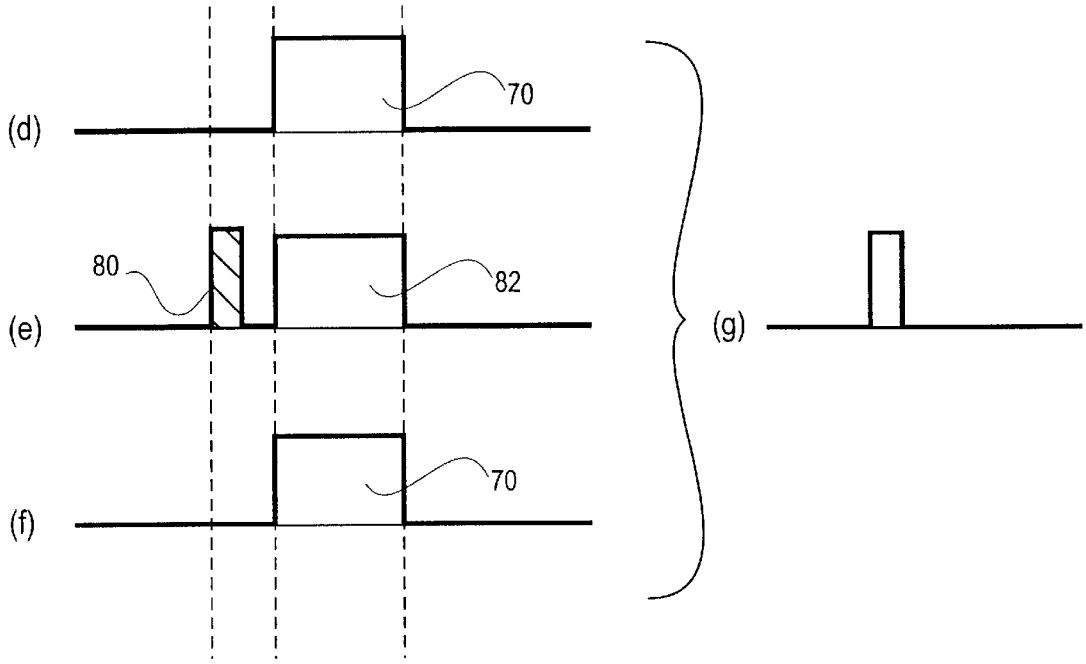
FIGS. 12 to 15 show alternative embodiments of actuation waveform to be applied to non-ejecting/enabled channel (e) and its neighbours, together with the resulting potential difference across the walls bonding channel (e)

FIG. 12 shows a second version of an enabled/non-ejecting waveform for use with the enabled/ejecting waveform of FIG. 11(*b*) and in place of the waveforms of FIG. 11(*d*)–(*f*). A first pulse 80 of duration (and, optionally, amplitude) insufficient to effect droplet ejection is applied synchronously with the first pulse 72 of the enabled/ejecting waveform of FIG. 11(*b*) and thereafter a second pulse 82 is applied to balance the pulse 70 applied to the adjacent disabled lines . The resulting potential difference is shown in FIG. 12(*g*).

Figure 13:
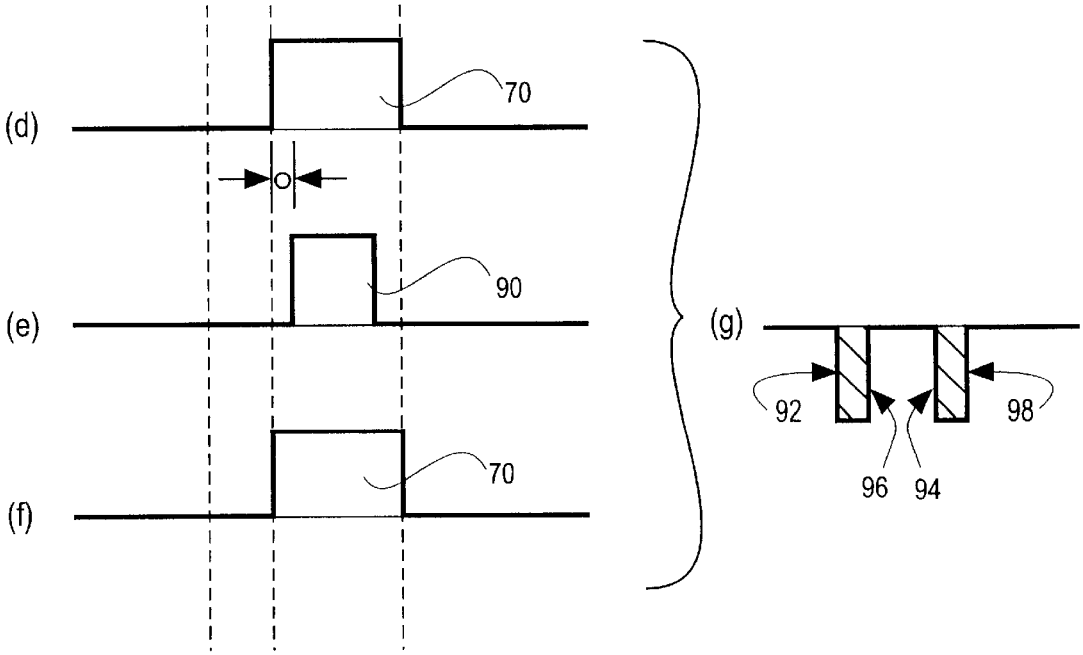

A third version of enabled/non-ejecting waveform for use in combination with the enabled/ejecting waveform of FIG. 11(*b*), is shown in FIG. 13. Pulse 90 is of the same amplitude as pulse 70 but is of shorter duration and is delayed in time by an amount 'o'. The resulting potential difference, shown in FIG. 13(*g*), has two pulses each of duration insufficient to eject a droplet. Such a potential difference has twice the number of edges (two rising edges 92,94 and two falling edges 96,98) and thus has the potential to generate twice the current flow of the potential difference of FIG. 12(*g*).

Figure 14:
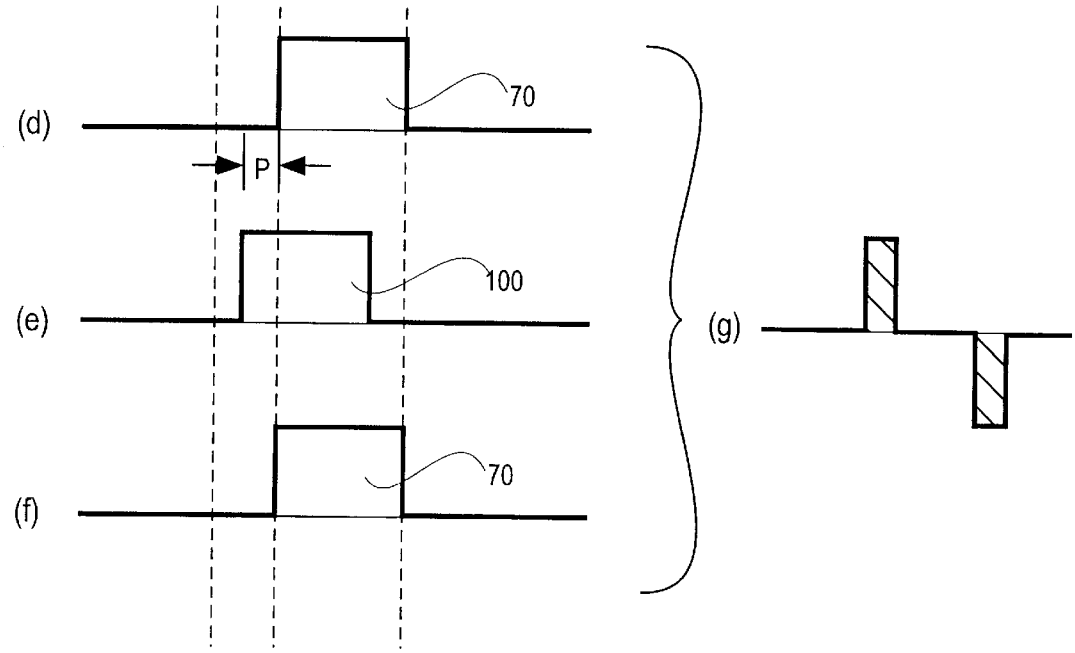

FIG. 14 illustrates a fourth version, namely a pulse 100 applied to channel (e) and having the same magnitude and duration as pulse 70 but advanced by an amount 'p' relative to the pulse 70. The resulting potential difference, illustrated in FIG. 14(*g*), has both positive and negative elements that generate positive and negative pressure waves in the channel. Offset 'p' and the duration of pulses 70,100 can be chosen such that the elements are delayed in time by 2AL/c so that the resulting pressure waves cancel one another in the channel, thereby reducing the amount of time taken for pressure waves in the channel to die down and thus the length of the droplet ejection period. This cancellation principle is known from the aforementioned WO95/25011, which also discloses the principle of making the second pulse of lower amplitude to allow for the fact that the first pulse is damped before being cancelled. This principle is also applicable in the present invention.

Figure 15:
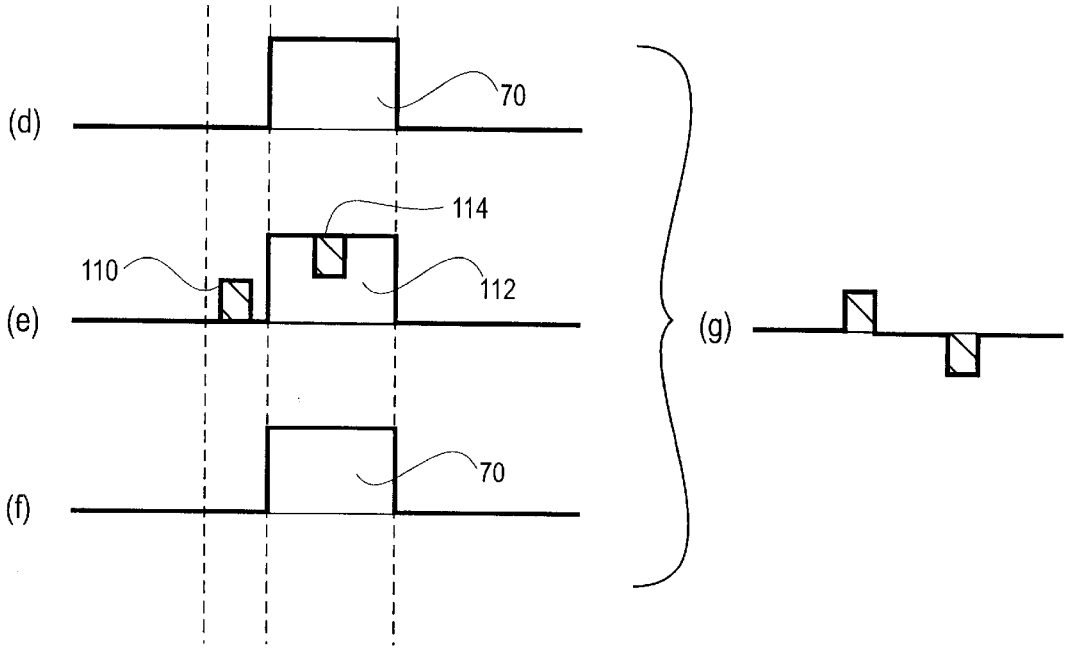

An enabled/non-ejecting waveform in accordance with FIG. 15 has an advantage over previous embodiments in that both the magnitude and the duration of the resulting potential difference across the walls bounding the non-ejecting channel can be controlled. To this end, a first, short pulse 110 is followed by a longer pulse 112 having identical timing, duration and magnitude as the pulses 70 except for a 'cutout' 114 having the same amplitude and duration as pulse 36'. The resulting potential difference is as shown in FIG. 14(*g*). Again, timing and magnitude of pulse 112 and cutout 114 can be chosen so as to reduce the length of the droplet ejection period as explained above.

Many other variations on the embodiments above will be obvious to the skilled man and are to be considered as comprised in the present invention.

During the periods when channels are disabled, there will of course be a reduction in the energy that they receive which could in turn result in a cooling of the ink therein. However, since all channels are disabled to the same proportion, such cooling will be the same for all disabled channels and the temperature of the ink will continue to remain substantially independent of the nature of the droplet ejection input data.

Figure 16:
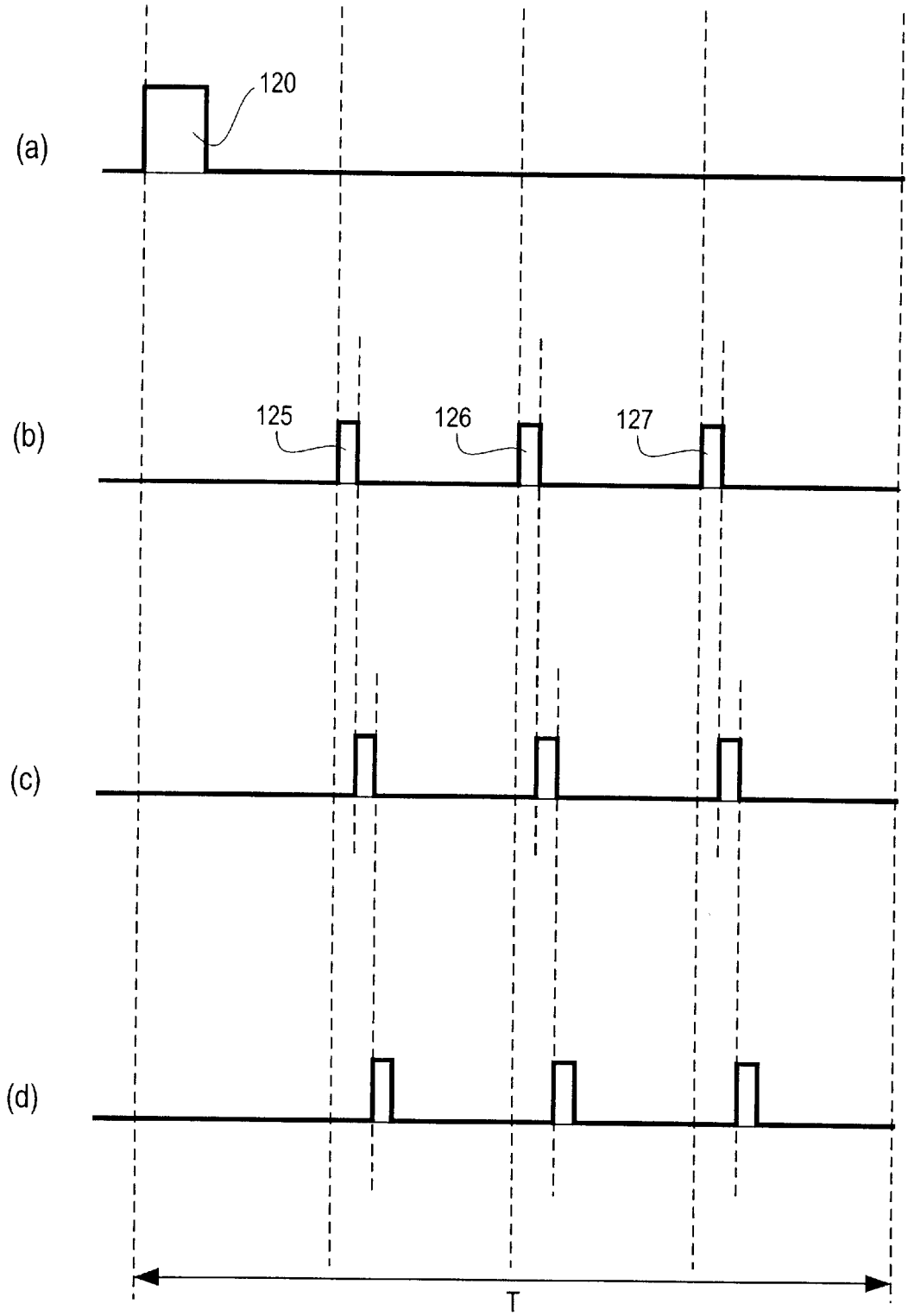
FIG. 16 illustrates the actuating voltage waveforms applied to four adjacent channels in a "shared-wall" printhead when operating according to another embodiment of the invention.

In an alternative embodiment, "enabled/non-ejecting' waveforms can be applied to all non-firing channels, be they enabled or disabled. FIG. 16 illustrates the waveforms applied to four adjacent channels in a "shared-wall" printhead and operating in three cycle mode. Channels (a) and (d) belong to the same, enabled channel group and are supplied with an enabled/ejecting "draw-release" waveform 120 (of the kind well known in the art) and three, reduced-width pulses 125, 126, 127 respectively. The reduced-width pulses are chosen so as to effect substantially the same temperature change in the ink as enabled/ejecting pulse 120.

Similar non-ejecting waveforms are applied to disabled channels (b) and (c). As shown, they are identical to those applied to channel (d), albeit staggered in time (it will be evident from the earlier description relating to FIGS. 2 to 4 that application of equal voltages to channels either side of an actuator wall would result in zero potential difference across the wall and therefore zero current flow and wall movement) and will generate the same temperature change of the ink in the respective channel as ejecting pulse 120.

One result of this additional energy input is that the printhead operates at a higher overall temperature. The energy input of the non-ejecting waveforms (dictated by the dimension and number of the pulses) on the non-enabled lines can advantageously be varied in real time by a controller so as to maintain the temperature of the head at a constant value.

This technique, namely the actuation of means to vary the volume of the chamber of an inkjet printhead without ejecting a droplet and with the express intention of raising the temperature of the ink in the chamber, is not restricted to situations where the temperature of the ink in a chamber is to be kept independent of the droplet ejection input data and can be used wherever it is desired to heat the ink, for example particularly but not exclusively with the objective of reducing temperature variations (and thus ejection velocity variations) between channels.

Also by way of example, the printhead may incorporate a temperature detector and the printhead controller may be arranged to adjust the magnitude or number of non-ejecting waveforms applied to maintain the printhead at a constant temperature based on feedback from the sensor. Alternatively, feedback from both an ambient temperature sensor and a printhead temperature sensor may be employed. Furthermore, should it be found that there is a non-uniform heat loss over the extent of a printhead—for example that there is greater heat loss to ambient non-channels of the extremities of the array—extra heat may be generated in these channels using non-droplet ejecting waveforms. It may also be desirable to heat selected channels to compensate for variations in inks of different colours, thereby to equalise the colour.

The technique is equally applicable to non-ejecting or ejecting channels: in the latter case, both a heating pulse and a droplet ejection pulse may be applied in a single droplet ejection period.

Droplet ejection velocity changes also occur at the commencement of printhead operation: even in the embodiments outlined above where the temperature of the ink remains independent of the print data, the heat generated in a channel will produce a temperature rise in the ink in that channel until an operating temperature is reached at which the heat generated in the channels equals the heat dissipated e.g. by convection from the printhead, by throughflow of ink. In accordance with another embodiment of the invention, the velocity changes associated with such a temperature variation can be avoided by applying to the channels of a printer which has been long quiescent a series of non-droplet ejection pulses to heat the ink to the operating temperature. In the case of actuators of the kind shown by way of example in FIGS. 2 to 4, the time constants of heating are 2 to 5 seconds. Conveniently, this time is of the order of the time spent by a printer in receiving data and carrying out other preparation and would not therefore constitute an additional delay.

The present invention is in no way restricted to those embodiments given by way of example above. In particular, the invention is applicable to any droplet deposition apparatus comprising a chamber supplied with droplet fluid and communicating with a nozzle for ejection of droplets therefrom and actuator means actuable by electrical signals to vary the volume of said chamber. Such actuation need not be piezoelectric—it may employ electrostatic means for example. Similarly, control in response to charge/current rather than electrical potential (as employed in the examples given) may prove desirable.

The present invention is also applicable to printheads operating in "multipulse" mode, i.e the successive ejection of several droplets from a channel which then merge either in flight or on the printing substrate to form a single printed dot. By varying the number of droplets ejected, the size of the printed dot can be controlled. Such operation is described in EP-A-0 422 870 and is commonly known as "greyscale operation".

Figure 17:
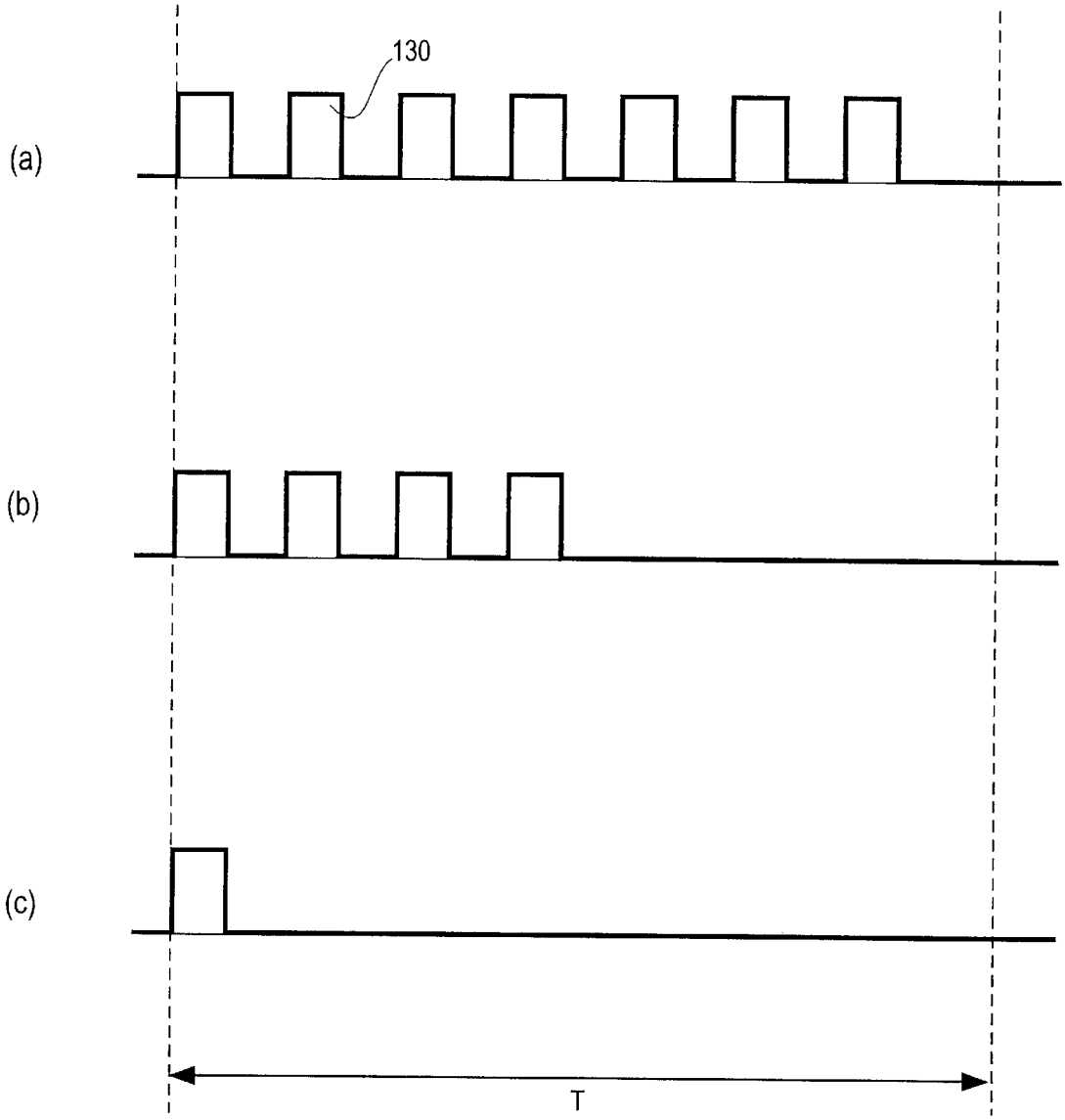
FIG. 17 represents conventional greyscale operation in three channels.

As will be evident from FIG. 17, which represents a conventional eight level multipulse operation (seven levels of grey plus white) with the "draw-release" actuating waveform 130 that might be applied to three—not necessarily adjacent—channels (a),(b) and (c) in response to print data specifying print densities of 7/7, 4/7 and 1/7 respectively, there will be a greater increase in the temperature of the ink when a high number of droplets are ejected than when a low number or zero droplets are ejected. Thus there is potential for temperature and ink viscosity differences between the channels, leading to print errors, and indeed these problems have been found to be more acute in a printhead operated in multipulse mode. This is attributed to the greater number of waveform edges and the reduced cooling effect of the smaller droplets employed.

Figure 18:
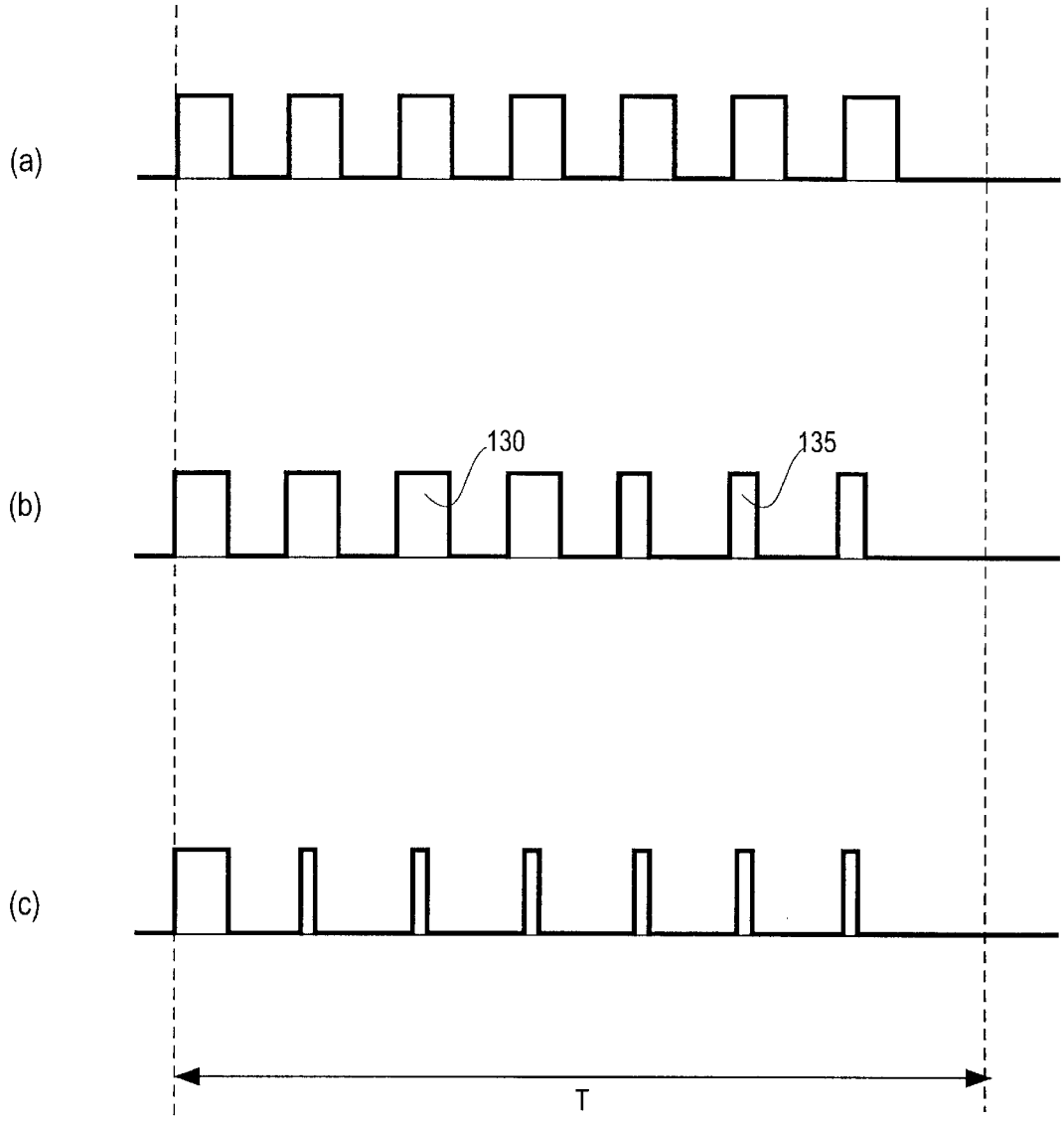
FIG. 18 corresponds to the operation of FIG. 17 when incorporating the present invention.

A solution to this problem in accordance with the present invention is illustrated by way of example in FIG. 18: it will be seen that in those channels (b) and (c) where less than the maximum possible number (seven in the example shown) of actuation pulses 130 is applied, further pulses 135 can be applied to make up the deficiency. The amplitude and/or duration of the further pulses 135 should be chosen such that although droplet ejection does not occur, the same temperature change is induced in the ink as by the actuating pulses 130. Thus the total energy dissipated in the period of enablement T remains independent of the print data. As is also known from EP-A-0 422 870, greyscale operation can be effected in groups or with adjacent channels operating in antiphase. In the former case, the methods of group operation described with regard to "binary" (firing either 1 drop or zero drops) operation above are applicable: non-enabled channels can either be left completely unactuated or fed with non-droplet ejecting waveforms of the type mentioned above. It may also be possible to actuate non-droplet-ejecting channels with a lesser number of waveforms having a longer duration than the droplet ejecting pulses but inducing the same temperature change in the ink. Note that other drop ejecting waveforms—for example the "draw-release-reinforce" waveform of FIG. 5(*a*)—may also be used in greyscale operation together with their non-ejecting counterpart waveforms.

It is believed that hysteresis loss in the piezoelectric material is the major—but not the sole—cause of heating of the ink in the channels of a printhead. Actuation of channels will give rise to movement of ink in the channels which in turn will increase the temperature by fluid friction, with a high level of channel operation giving rise to a greater increase in ink temperature than a low level. Yet another source of heat will be resistance losses in the actuating electrodes. Empirically-derived non-ejecting waveforms will take account of such further loss mechanisms. They may also be incorporated to a greater or lesser extent into the mathematical model described above.

As mentioned at the beginning of the description, "thermal" printheads operate on the principle of heating ink in a chamber to create a vapour bubble which pushes ink out of the chamber via a nozzle. Such heating is localised to that section of the channel in which the heater is located, however, and it has been recognised by the present inventors that, in the ink in the nozzle and the part of the channel adjacent thereto which is remote from the heater, problems with variation in droplet ejection speed due to differences in ink temperature—similar to the problems discussed with reference to FIG. 1—may occur. It is believed that the solutions outlined above with regard to "variable volume chamber" devices may also be applicable to "thermal" printheads. In particular, non-ejecting actuating signals may be applied to a channel, the signals being chosen so as to induce the same temperature change in the fluid at the nozzle as droplet-ejecting signals.

The manner in which the short duration pulses 24,26,30, 32,36 of FIGS. 11 to 15 are applied comprises a further aspect of the present invention, namely the method of operation of droplet deposition apparatus comprising a chamber supplied with droplet fluid, a nozzle communicating with the channel for ejection of droplets therefrom and actuator means having first and second electrodes and actuable by a potential difference applied across first and second electrodes to effect droplet ejection from the chamber via the nozzle; the method comprising the steps of applying to the first electrode a first non-zero voltage for a first duration, applying to the second electrode a second non-zero voltage for a second duration, the first and second voltages being applied simultaneously for a length of time less than at least one of said first and second durations.

This further aspect is particularly advantageous when applying short pulses of the kind shown in FIGS. 11 to 15. For a printhead operating at a droplet ejection frequency of 100 kHz for example, such pulses could have a duration as short as 1 $\mu$s. Circuitry to generate such short pulses can be complex and consequently expensive. By using the aforementioned second concept, it is possible to apply short duration pulses using longer duration signals which are easier to generate.

The concept is also of use when operating a "shared-wall" printhead in two-cycle, two-phase mode as discussed in WO96/10488. Successive channels in an array are alternately assigned to one of two groups, with each group being alternately enabled for droplet ejection in successive cycles. Within each cycle, successive channels in a group eject droplets in antiphase. This mode is particularly suited to multipulse operation, with a number of droplets being ejected from a channel in any one cycle in accordance with the input data, thereby to form a corresponding printed dot.

Figure 19:
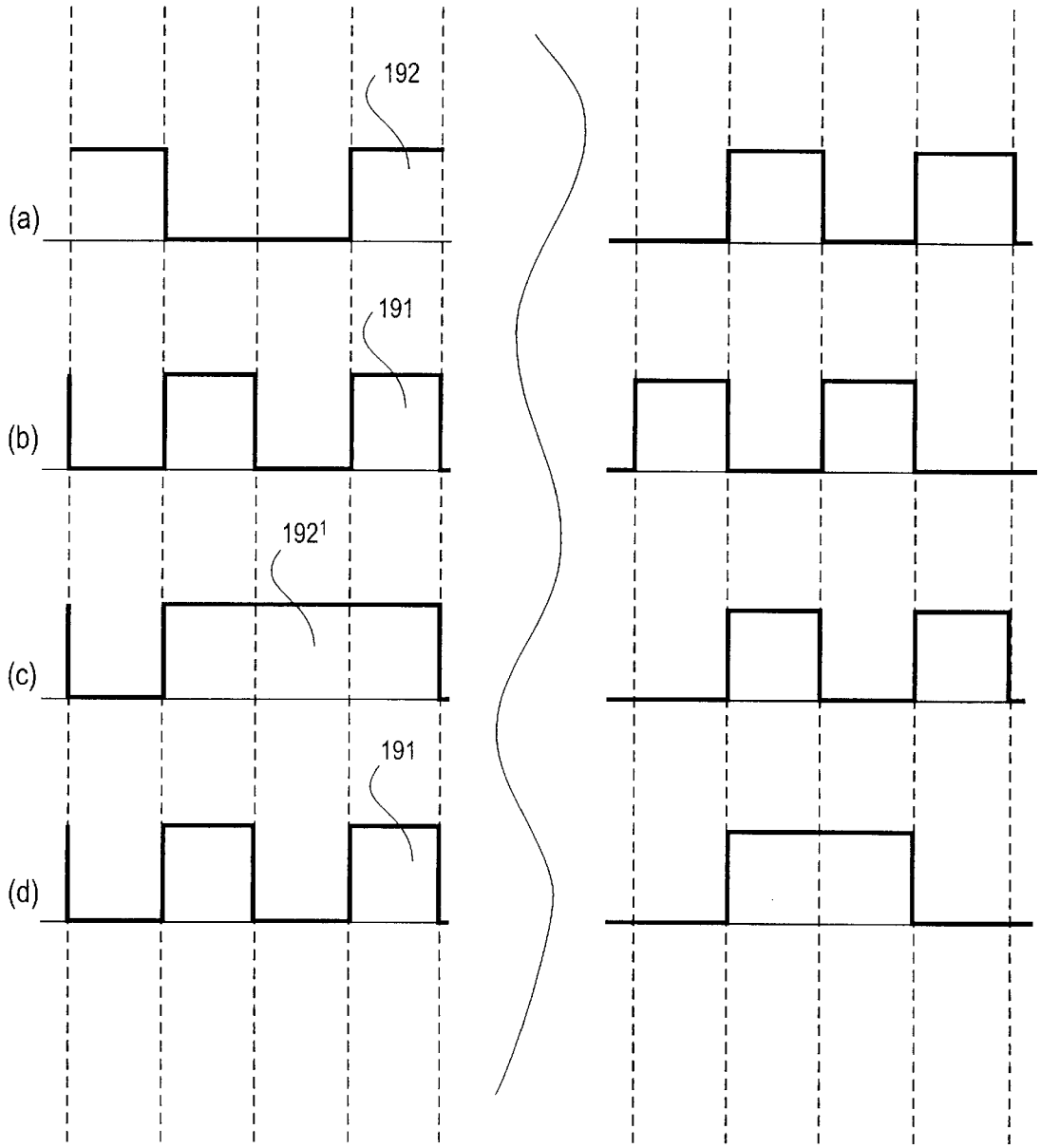
FIG. 19 illustrates the actuating voltage waveforms applied to four adjacent channels when operating according to a second aspect of the present invention.

FIG. 19 illustrates the voltage waveforms to be applied to four adjacent channels a,b,c,d of a "shared wall" printhead to implement two cycle/two phase operation in accordance with the aforementioned concept of the present invention. The corresponding potential difference variation across the walls bounding channels a–d is shown in FIG. 20.

The left-hand side of FIG. 19 corresponds to a first cycle of operation where the group including channels (a) and (c) are enabled. To each channel in the disabled group—which includes channels (b) and (d)—there is applied a common repeating waveform 191 which, in the example shown, comprises a square pulse of duration AL/c followed by a dwell period also of duration AL/c.

A similar repeating waveform 192, 192' having the same amplitude is applied to enabled channels, albeit with square pulse and dwell period durations of 2AL/c and with the waveform 192' applied to channel (c) 180 degrees out of phase with the waveform 192 applied to channel (a). FIG. 20 illustrates the resulting potential differences 201,202 across the actuator walls bounding channels (a) and (c) and which will result in "draw-release-reinforce" actuation of channel (a) thereby to eject a droplet. Since the similar actuation of channel (c) takes place 2AL/c later, the droplet ejection from this channel will be in antiphase with that from channel (a). Both channels (a) and (c) may be actuated several times in immediate succession in accordance with the input print data so as to eject several droplets and form a correspondingly-sized printed dot.

Figure 20:
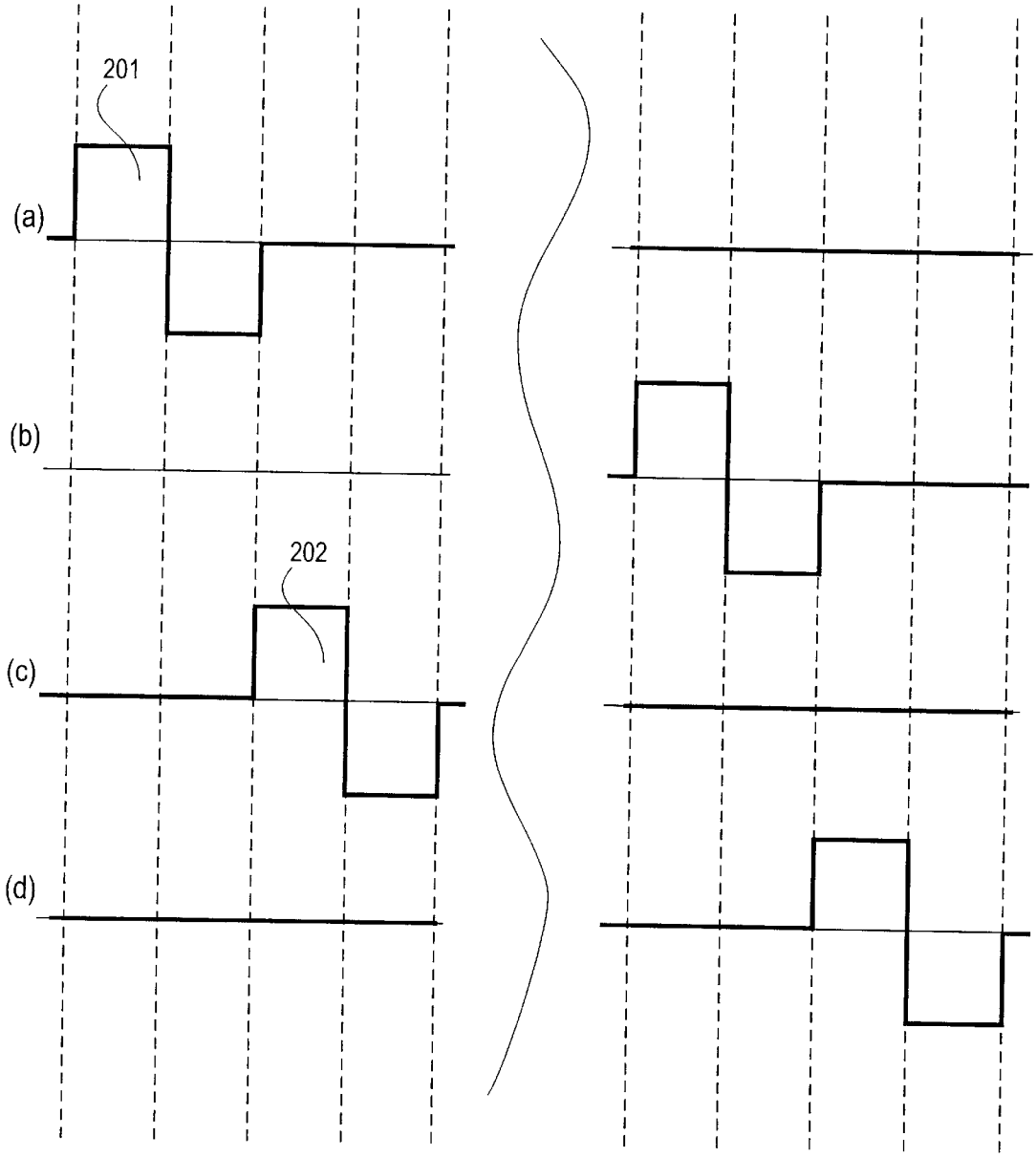
FIG. 20 illustrates the potential differences generated across the walls of enabled channels when actuated by the waveforms of FIG. 19.

The right-hand side of FIGS. 19 and 20 shows the similar behaviour when the second group including channels (b) and (d) is enabled and actuated in accordance with the print data.

Figure 21:
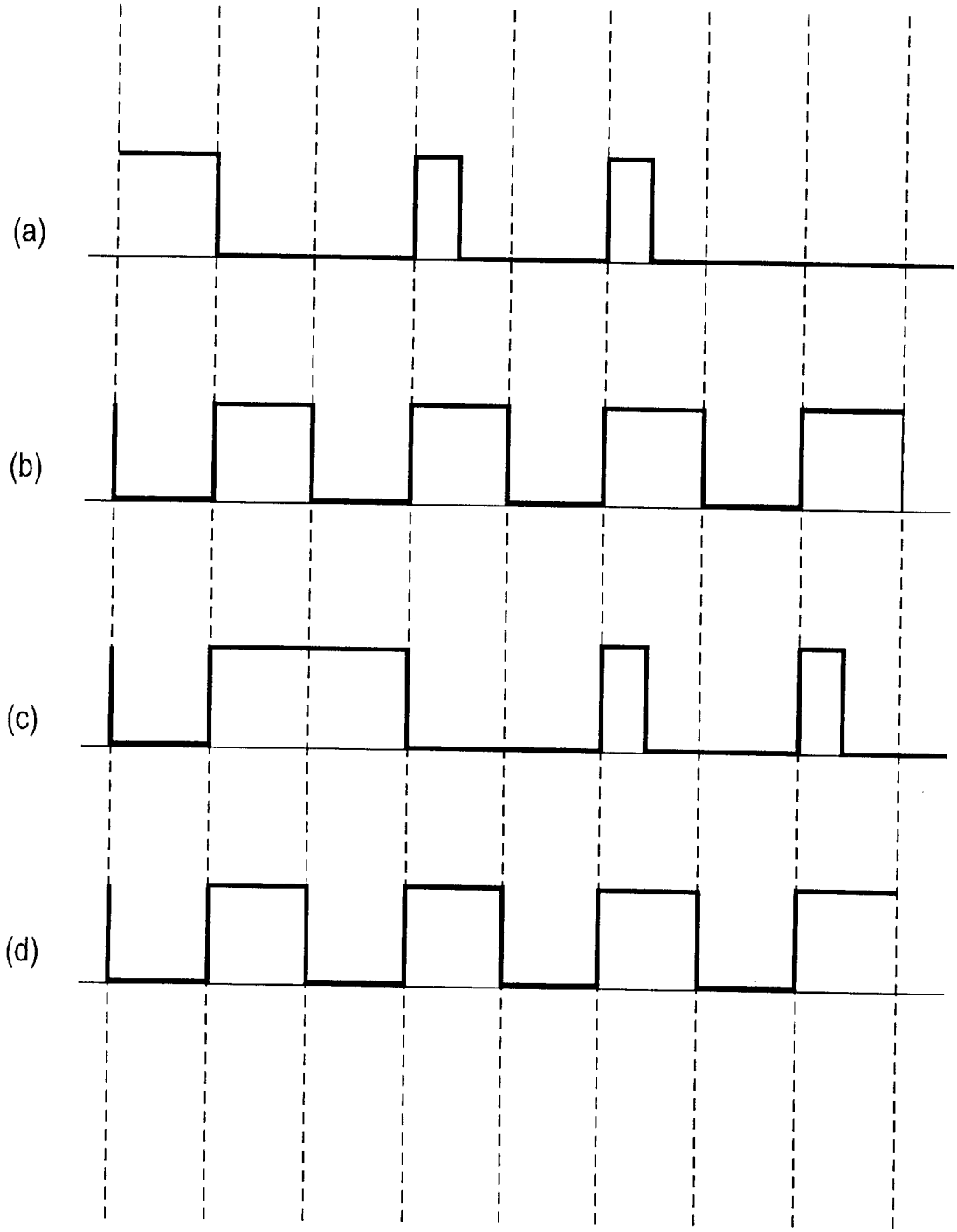
FIGS. 21 and 22 correspond to the left-hand portions of FIGS. 19 and 20 when utilising a first aspect of the present invention.
Figure 22:
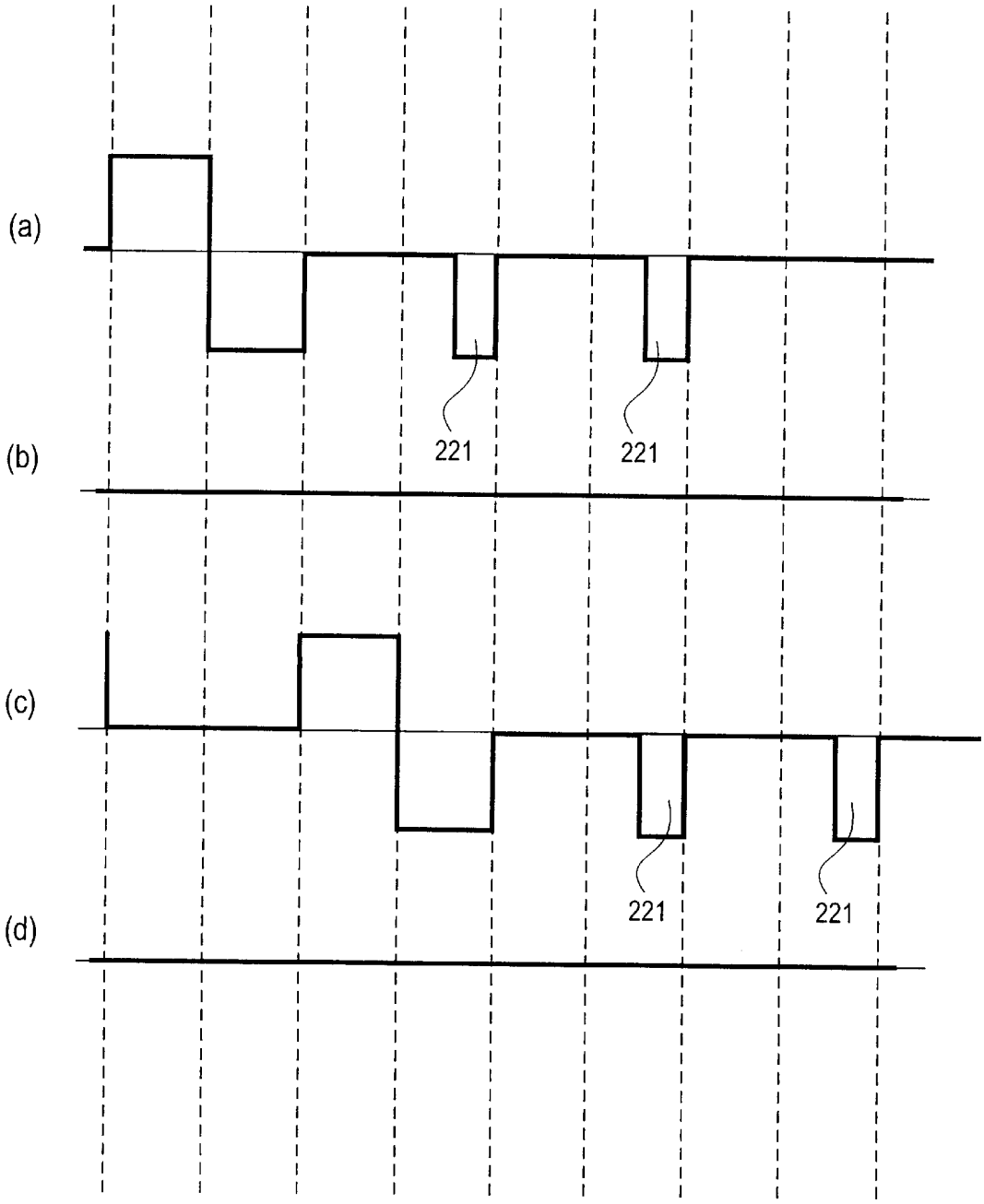

FIGS. 21 and 22 are similar to FIGS. 16 and 17 in demonstrating that the temperature of the droplet fluid in a chamber can be maintained independent of the droplet ejection input data by applying further non-ejecting pulses—in this case a potential difference 221 of width insufficient to induce droplet ejection—in place of the ejecting pulses that might otherwise be applied. The amplitude/duration/number of these pulses can be chosen using either of the empirical or theoretical methods outlined above to generate losses (particularly hysteresis) and thereby heat such that the temperature of the ink in the channel remains independent of the number of ejecting pulses applied in a droplet ejection period.

Figure 23:
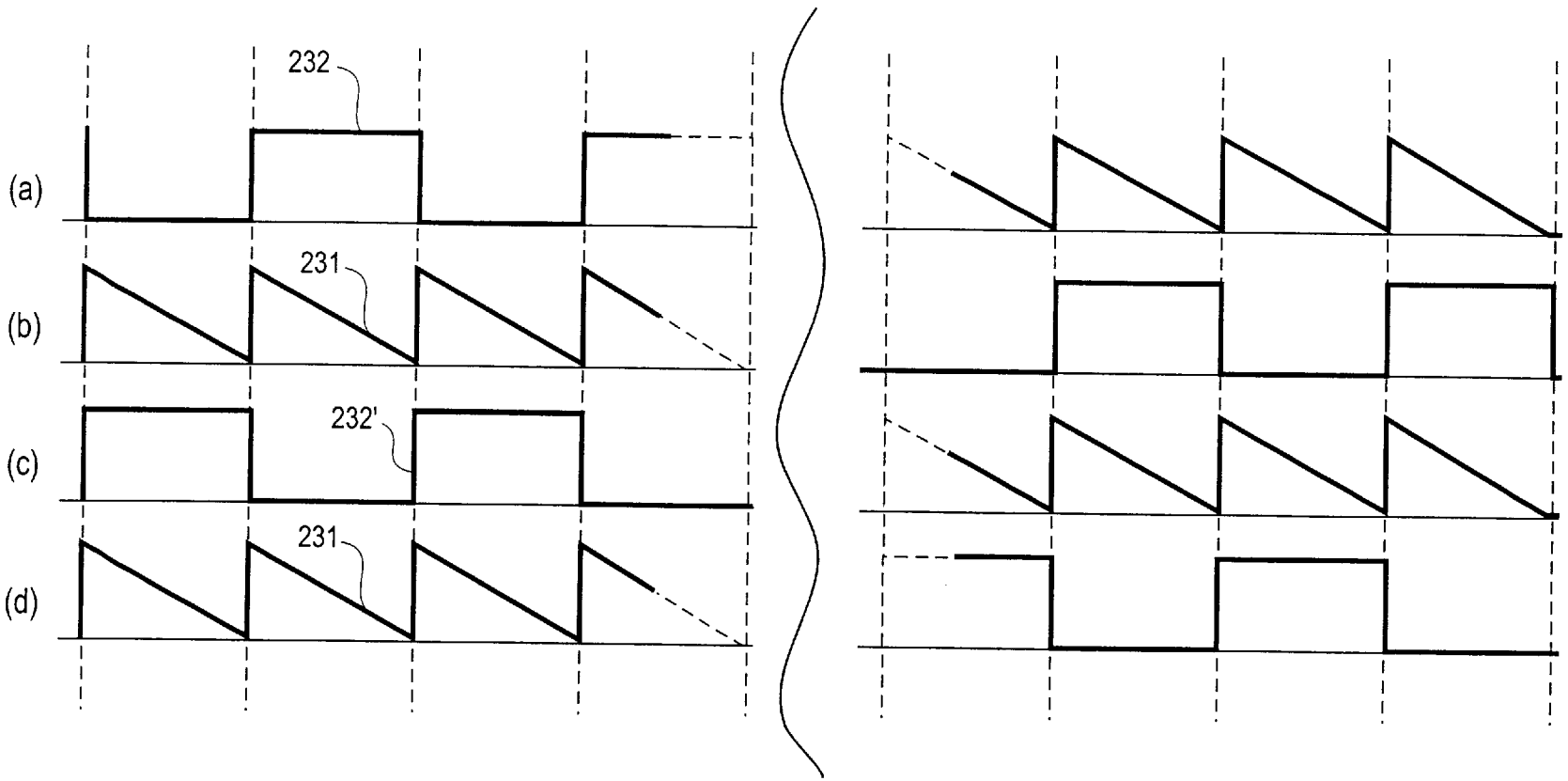
FIGS. 23 and 24 illustrate an alternative embodiment of the manner of operation shown in FIGS. 19 and 20.
Figure 24:
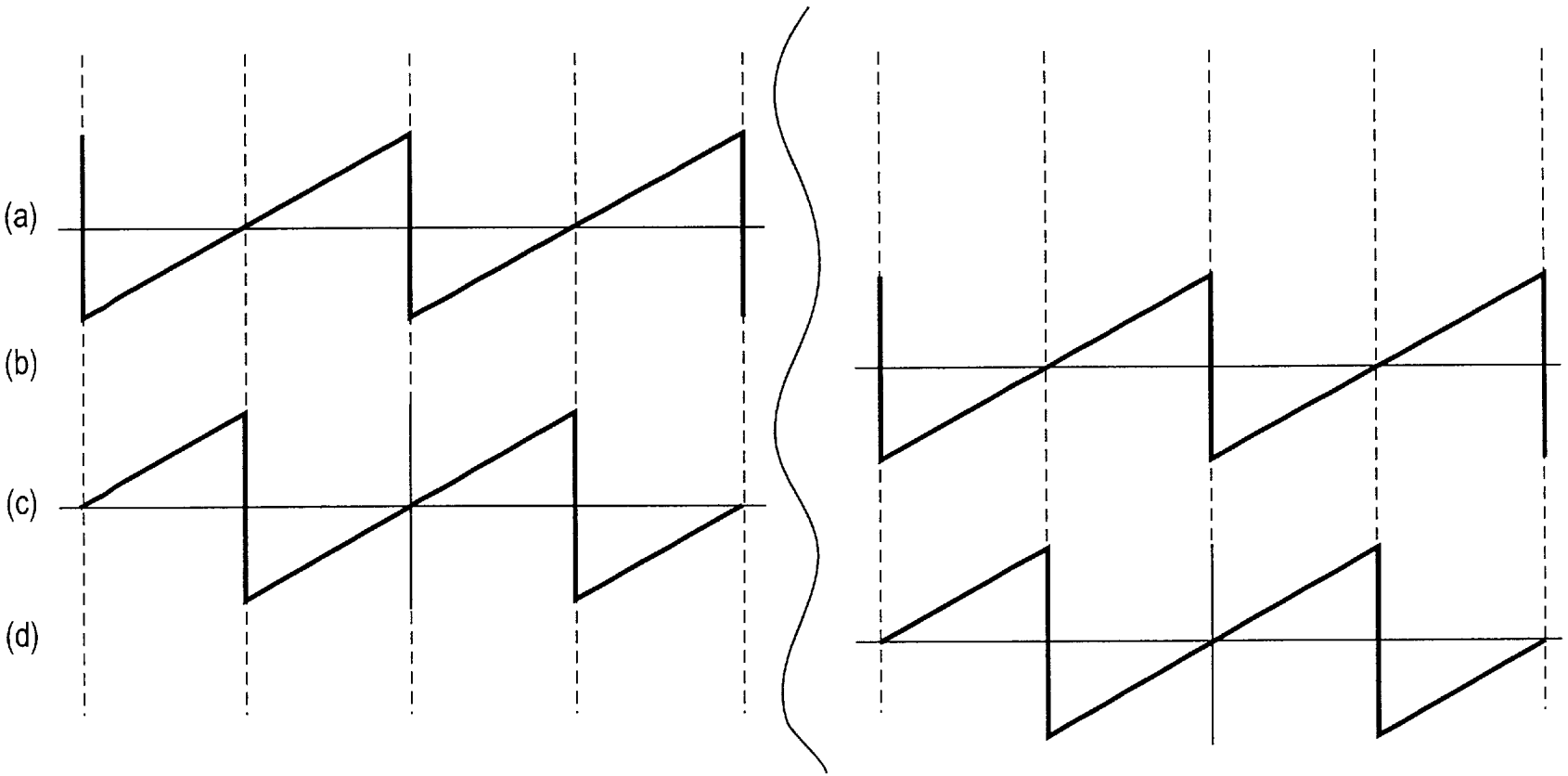

FIG. 23 shows an alternative embodiment of the two cycle/two phase concept. A repeating "sawtooth" actuating voltage waveform 231—known per se in the art—is applied to the disabled channels (b) and (d), whilst to the enabled channels (a) and (c) there is applied a square wave 232,232' of the same amplitude but half the repeating frequency, with the waveform 232 applied to channel (a) being in antiphase to the waveform 232' applied to the neighbouring channel in the same group, namely channel (c). The potential difference across the channel walls of the enabled channels is shown in FIG. 24: again a sawtooth waveform, it has twice the amplitude of either the actuating waveforms applied to the channels as per FIG. 23 due to the action of the enabled channel voltage falling whilst the voltage applied to the immediate neighbours is rising. The right-hand side of FIGS. 23 and 24 illustrate the situation when channels (b) and (d) are enabled. It will be evident that droplet ejection, initiated by the vertical edge of the waveform, can take place at a higher rate than possible with the embodiment of FIG. 19. Droplet ejection between neighbouring channels in the same enabled group will still be in antiphase, however. Furthermore, this waveform has been found to reduce pressure crosstalk between channels in a "shared-wall" printhead which might otherwise cause non-ejecting channels to eject accidentally.

Each feature disclosed in this specification (which term includes the claims) and/or shown in the drawings may be incorporated in the invention independently of other disclosed and/or illustrated features.

The text of the abstract filed herewith is repeated here as part of the specification.

In droplet deposition apparatus comprising one or more independently actuable ink ejection chambers, electrical signals are applied to reduce variation in the temperature of the droplet fluid between chambers and with variations in droplet ejection input data. Short potential difference pulses, suitable for influencing the temperature of the droplet fluid in a chamber, can be generated by application of longer duration voltages to ink chamber actuation means.

What is claimed is:

1. Method of operating droplet deposition apparatus comprising first and second chambers each supplied with droplet fluid and communicating with a respective nozzle for ejection of droplets therefrom and each having an actuator actuable by electrical signals to vary the volume of that chamber, volume variation sufficient to effect droplet ejection being effected in accordance with droplet ejection input data, said method comprising, in a droplet ejection period, the steps of supplying to said actuator of said first chamber a plurality of first electrical signals to effect ejection from the first chamber of a corresponding number of droplets to form a printed dot of appropriate tone on a surface, and supplying to said actuator of said second chamber a number of second electrical signals that do not effect drop ejection from the second chamber, wherein the change in temperature of the droplet fluid ins aid first chamber caused by the application of said first electrical signals is substantially equal to that in the droplet fluid in said second chamber caused by the application of said second electrical signals.

2. Method according to claim 1, wherein a said second electrical signal has an amplitude below that required to effect droplet ejection.

3. Method according to claim 1, wherein a said second signal has a duration less than that required to effect droplet ejection.

4. Method according to claim 1, wherein a said second signal is deficient in those frequencies required to effect droplet ejection.

5. Method according to claim 1, wherein a said second signal comprises two sub-signals, applied serially to effect an increase in chamber volume and a decrease in chamber volume and a decrease in chamber volume respectively.

6. Method according to claim 5, wherein said sub-signals are delayed relative to one another such that the respective pressure waves caused by the signals substantially cancel out.

7. Method according to claim 1, wherein each said actuator comprises piezoelectric material.

8. Method according to claim 7, wherein said piezoelectric material extends over the major part of a wall of a respective said chamber.

9. Method according to claim 7, wherein a said second signal generates hysteresis losses in said piezoelectric material.

10. Method according to claim 9, wherein the hysteresis losses generated in said piezoelectric material by a said second signal are greater than 50% of the hysteresis losses generated in said piezoelectric material by a said first signal.

11. Method according to claim 9, wherein the hysteresis losses generated in said piezoelectric material by a said second signal are approximately 60% of the hysteresis losses generated in said piezoelectric material by a said first signal.

12. Method according to claim 1, wherein said chambers are part of an array of channels formed in a base, walls being defined between said channels, with each wall comprising piezoelectric material actuable by first and second electrical signals to deflect said wall relative to a channel, thereby to vary the volume of said channel.

13. Method according to claim 12, comprising the steps of assigning successive chambers of the array to one of a plurality of groups in a regular manner enabling each group of channels for actuation in successive periods, and effecting droplet ejection from chambers of an enabled group in accordance with the droplet ejection input data, and controlling said electrical signals such that the temperature of the droplet fluid in each of the chambers of an enabled group remains substantially independent of variations in the droplet ejection input data.

14. Method according to claim 13, and comprising the steps of applying said first electrical signals to the chambers of an enabled group where said droplet ejection input data specifies droplet ejection and applying said second signals to those chambers of an enabled group where said droplet ejection input data does not specify droplet ejection.

15. Method according to claim 14, wherein third signals are applied to those chambers of the array that are not enabled.

16. Method according to claim 15, wherein the change in temperature of the droplet fluid in a chamber caused by an application of said third electrical signal is substantially equal to that caused by the application of a said first or a said second electrical signal.

17. Method according to claim 1, wherein the second electrical signals are controlled in dependence on a further signal representative of temperature.

18. Method according to claim 17, wherein said further signal is representative of the temperature of the apparatus, said second electrical signals being applied to maintain the temperature of the apparatus at a constant value.

19. Method according to claim 17, wherein said further signal is representative of both the temperature of the apparatus and the ambient temperature, said second electrical signals being applied to maintain the temperature of the apparatus at a constant value.

20. Method according to claim 17, wherein said apparatus comprises an array of chambers and said further signal is representative of the temperature of the droplet fluid in chambers at the extremities of said array.

21. Method according to claim 17, wherein the chambers are part of an array of chambers, the method comprising assigning successive chambers of the array to one of a plurality of groups in a regular manner, enabling each group of channels for actuation in successive periods, and effecting droplet ejection from chambers of an enabled group in accordance with the droplet ejection input data, and applying to chambers belonging to groups that are not enabled said second electrical signals.

22. Method according to claim 21, wherein said second electrical signals are applied to chambers belonging to both enabled and disabled groups.

23. Method according to claim 1, wherein the actuator means of each chamber has first and second electrodes actuable by a potential difference applied across the first and second electrodes to effect droplet ejection from the chamber via the nozzle; the fluid in the second chamber being selectively electrically heated by applying to the first electrode a first non-zero voltage signal for a first duration, applying to the second electrode a second non-zero voltage signal for a second duration, the first and second voltage signals being applied simultaneously for a length of time less than at least one of said first and second durations.

24. Method according to claim 23, and comprising the steps of applying first and second voltage signals of the same polarity.

25. Method according to claim 23, and comprising the steps of applying first and second voltage signals of equal magnitude.

26. Method according to claim 23, wherein one of said first and second voltage signals is both applied before the other one of said first and second voltage signals and removed before the other one of said first and second voltage signals.

27. Method according to claim 23, and comprising the steps of applying first and second voltage signals of equal duration and delayed in time relative to one another.

28. Method according to claim 23, and comprising the steps of applying first and second voltage signals that vary in magnitude with time.

29. Method according to claim 23, and comprising the steps of increasing said first voltage signal while decreasing said second voltage signal.

30. Method according to claim 23, and comprising the steps of applying first and second voltage signals that vary in a stepwise fashion from a first magnitude to a second magnitude and back to the first magnitude.

31. Method according to claim 23, wherein said apparatus comprises a multiplicity of channels each forming a said chamber and mutually spaced in an array direction normal to the length of the channels and separated one from the next by side walls extending in the lengthwise direction of the channels; a said actuator being associated with each said side wall and actuable to deflect the wall, thereby to effect droplet ejection from an associated channel; the first and second electrodes of each actuator terminating in one or the other of the channels separated by said side wall respectively.

32. Method according to claim 31, wherein a channel contains a common termination for electrodes of the two actuators associated with the two channel walls bounding said channel.

33. Method according to claim 32, and comprising the steps of alternately assigning successive channels of the array to one of two groups and alternately enabling each group for droplet ejection in successive cycles; applying to the common termination in channels belonging to the group that is enabled first voltage signals repeating at a first frequency; and applying to the common terminations of channels belonging to the group that is not enabled second voltage signals in accordance with droplet ejection input data.

34. Method according to claim 33, comprising the further steps of alternately assigning successive channels of an enabled group to first and second sub-groups; applying to the common terminations of channels belonging to said first sub-group a third voltage signal repeating at half said first frequency; applying to the common terminations of channels belonging to said second sub-group a fourth voltage signal also repeating at half said first frequency; said third and fourth voltage signals being in anti-phase.

35. Method according to claim 34, and wherein said first voltage signal comprises a stepwise voltage increase, followed by a stepwise voltage decrease at a time T thereafter, followed by a dwell at zero voltage again for a time T; said third and fourth voltage signals each comprising a stepwise voltage increase, followed by a stepwise voltage decrease at a time 2T thereafter, followed by a dwell at zero voltage again for a time 2T.

36. Method according to claim 34, and wherein said first voltage comprises a sawtooth voltage waveform having a period of repetition equal to time T; and wherein said third and fourth voltage signals each comprise a stepwise voltage increase, followed by a stepwise voltage decrease at a time T thereafter, followed by a dwell at zero voltage again for a time T.

37. Method according to claim 1, wherein at least one second signal is supplied to said actuator of said first channel during said droplet ejection period.

38. Method according to claim 37, wherein at least one first signal is supplied to said actuator of said second channel during said droplet ejection period.

39. Method according to claim 38, wherein during said droplet ejection period the sum of the number of first signals and the number of second signals supplied to said actuator of said first channel corresponds to the sum of the number of said first signals and the number of said second signals supplied to said actuator of said second channel.

40. Method according to claim 38, wherein the sum of the number of said first signals and the number of said second signals applied to a said chamber is constant for successive droplet ejection periods.

41. Signal processing means for operating a droplet deposition apparatus comprising first and second chambers each supplied with droplet fluid and communicating with a respective nozzle for ejection of droplets therefrom and each having a respective actuator actuable by electrical signals to vary the volume of that chamber, volume variation sufficient to effect droplet ejection being effected in accordance with droplet ejection input data; said signal processing means being configured to supply to said actuator means of said first chamber a plurality of first electrical signals to effect ejection from the first chamber of a corresponding number of droplets to form a printed dot of appropriate tone on a surface, and supply to said actuator means of said second chamber a number of second electrical signals that do not effect drop ejection from the second chamber, wherein the change in temperature of the droplet fluid in said first chamber caused by the application of said first electrical signals is substantially equal to that in the droplet fluid in said second chamber caused by the application of said second electrical signals.

42. In combination, droplet deposition apparatus comprising first and second chambers each supplied with droplet fluid and communicating with a respective nozzle for ejection of droplets therefrom and having a respective actuator actuable by electrical signals to vary the volume of that chamber, volume variation sufficient to effect droplet ejection being effected in accordance with droplet ejection input data; and signal processing means for applying said electrical signals, said signal processing means being configured to supply to said actuator means of said first chamber a plurality of first electrical signals to effect ejection from the first chamber of a corresponding number of droplets to form a printed dot of appropriate tone on a surface, and supply to said actuator means of said second chamber a number of second electrical signals that do not effect drop ejection from the second chamber, wherein the change in temperature of the droplet fluid in said first chamber caused by the application of said first electrical signals is substantially equal to that in the droplet fluid in said second chamber caused by the application of said second electrical signals.

* * * * *

UNITED STATES PATENT AND TRADEMARK OFFICE

CERTIFICATE OF CORRECTION

PATENT NO. : 6,568,779 B1
DATED : May 27, 2003
INVENTOR(S) : Robert M. Pulman et al.

It is certified that error appears in the above-identified patent and that said Letters Patent is hereby corrected as shown below:

Column 15, line 52 - Column 20, line 14,
Delete all of claims 1-42 and replace with the following:

1. Method of operating droplet deposition apparatus, said method comprising the steps of:

providing an apparatus comprising first and second chambers each supplied with droplet fluid and communicating with a respective nozzle for ejection of droplets therefrom and each having an actuator actuable by electrical signals to vary the volume of that chamber, volume variation sufficient to effect droplet ejection being effected in accordance with droplet ejection input data;

applying, in a droplet ejection period, to said actuator of said first chamber a plurality of first electrical signals to effect ejection from the first chamber of a corresponding number of droplets to form a printed dot of appropriate tone on a surface; and applying, in the droplet ejection period, to said actuator of said second chamber a number of second electrical signals that do not effect drop ejection from the second chamber, wherein a change in temperature of the droplet fluid in said first chamber caused by the application of said first electrical signals is substantially equal to that in the droplet fluid in said second chamber caused by applying said second electrical signals.

2. Method according to claim 1, wherein the step of applying said second electrical signals further comprises applying a said second electrical signal that has an amplitude below that required to effect droplet ejection.

3. Method according to claim 1, wherein the step of applying said second electrical signals further comprises applying a said second signal that has a duration less than that required to effect droplet ejection.

4. Method according to claim 1, wherein the step of applying said second electrical signals further comprises applying a said second signal that is deficient in those frequencies required to effect droplet ejection.

5. Method according to claim 1, wherein the step of applying said second electrical signals further comprises applying a said second signal that comprises two sub-signals, applied serially to effect an increase in chamber volume and a decrease in chamber volume and a decrease in chamber volume respectively.

6. Method according to claim 5, wherein the step of applying a said second signal further comprises applying said sub-signals delayed relative to one another such that the respective pressure waves caused by the sub-signals substantially cancel out.

7. Method according to claim 1, wherein the step of providing an apparatus further comprises providing each said actuator of a piezoelectric material.

8. Method according to claim 7, wherein the step of providing an apparatus further comprises providing said piezoelectric material extending over the major part of a wall of a respective said chamber.

9. Method according to claim 7, wherein the step of applying said second electrical signals further comprises applying a said second signal that generates hysteresis losses in said piezoelectric material.

10. Method according to claim 9, wherein the step of applying a said second signal results in the hysteresis losses generated in said piezoelectric material by the said second signal being greater than 50% of the hysteresis losses generated in said piezoelectric material by a said first signal.

It is certified that error appears in the above-identified patent and that said Letters Patent is hereby corrected as shown below:

Column 15, line 52 - Column 20, line 14 (cont'd),

11. Method according to claim 9, wherein the step of applying a said second signal results in the hysteresis losses generated in said piezoelectric material by the said second signal being approximately 60% of the hysteresis losses generated in said piezoelectric material by a said first signal.

12. Method according to claim 1, wherein the step of providing an apparatus further comprises providing said chambers as part of an array of channels formed in a base, walls being defined between said channels, with each wall comprising piezoelectric material actuable by first and second electrical signals to deflect said wall relative to a channel, thereby to vary the volume of said channel.

13. Method according to claim 12, further comprising the steps of assigning successive chambers of the array to one of a plurality of groups of channels in a regular manner enabling each group of channels for actuation in successive periods, and effecting droplet ejection from chambers of an enabled group in accordance with the droplet ejection input data, and controlling said electrical signals such that the temperature of the droplet fluid in each of the chambers of an enabled group remains substantially independent of variations in the droplet ejection input data.

14. Method according to claim 13, further comprising the steps of applying said first electrical signals to the chambers of an enabled group where said droplet ejection input data specifies droplet ejection and applying said second electrical signals to those chambers of an enabled group where said droplet ejection input data does not specify droplet ejection.

15. Method according to claim 14, further comprising the step of applying third signals to those chambers of the array that are not enabled.

16. Method according to claim 15, wherein the step of applying said third electrical signals results in a change in temperature of the droplet fluid in a chamber is substantially equal to that caused by the application of a said first or a said second electrical signal.

17. Method according to claim 1, wherein the step of applying said second electrical signals further comprises controlling the second electrical signals in dependence on a further signal representative of temperature.

18. Method according to claim 17, wherein the step of controlling further comprises said further signal being representative of a temperature of the apparatus, and applying said second electrical signals to maintain the temperature of the apparatus at a constant value.

19. Method according to claim 17, wherein the step of controlling further comprises said further signal being representative of both a temperature of the apparatus and ambient temperature, and applying said second electrical signals to maintain the temperature of the apparatus at a constant value.

20. Method according to claim 17, wherein the step of providing an apparatus further comprises providing the chambers as part of an array of chambers, and further comprising the steps of assigning successive chambers of the array to one of a plurality of groups in a regular manner, enabling each group of channels for actuation in successive periods, and effecting droplet ejection from chambers of an enabled group in accordance with the droplet ejection input data, and applying said second electrical signals to chambers belonging to groups that are not enabled.

21. Method according to claim 20, wherein the step of providing an apparatus further comprises providing said apparatus comprised of an array of chambers, and wherein said step of controlling further comprises said further signal being representative of a temperature of the droplet fluid in chambers at extremities of said array.

It is certified that error appears in the above-identified patent and that said Letters Patent is hereby corrected as shown below:

Column 15, line 52 - Column 20, line 14 (cont'd),

22. Method according to claim 20, wherein the step of applying said second electrical signals further comprises applying said second electrical signals to chambers belonging to both enabled and disabled groups.

23. Method according to claim 1, wherein the step of providing an apparatus further comprises providing the actuator means of each chamber with first and second electrodes actuable by a potential difference applied across the first and second electrodes to effect droplet ejection from the chamber via the nozzle; and further comprising the steps of selectively electrically heating the fluid in the second chamber by applying to the first electrode a first non-zero voltage signal for a first duration, applying to the second electrode a second non-zero voltage signal for a second duration, the first and second non-zero voltage signals being applied simultaneously for a length of time less than at least one of said first and second durations.

24. Method according to claim 23, wherein the step of selectively electrically heating further comprises applying said first and second non-zero voltage signals of the same polarity.

25. Method according to claim 23, wherein the step of selectively electrically heating further comprises applying said first and second non-zero voltage signals of equal magnitude.

26. Method according to claim 23, wherein the step of selectively electrically heating further comprises both applying one of said first and second non-zero voltage signals before the other one of said first and second non-zero voltage signals and removing the one of said first and second non-zero voltage signals before the other one of said first and second non-zero voltage signals.

27. Method according to claim 23, wherein the step of selectively electrically heating further comprises applying said first and second non-zero voltage signals of equal duration and delayed in time relative to one another.

28. Method according to claim 23, wherein the step of selectively electrically heating further comprises applying said first and second non-zero voltage signals that vary in magnitude with time.

29. Method according to claim 23, wherein the step of selectively electrically heating further comprises increasing said first non-zero voltage signal while decreasing said second non-zero voltage signal.

30. Method according to claim 23, wherein the step of selectively electrically heating further comprises applying said first and second non-zero voltage signals that vary in a stepwise fashion from a first magnitude to a second magnitude and back to the first magnitude.

31. Method according to claim 23, wherein the step of providing an apparatus further comprises providing said apparatus having a multiplicity of channels each forming a said chamber and mutually spaced in an array direction normal to the length of the channels and separated one from the next by side walls extending in the lengthwise direction of the channels; a said actuator being associated with each said side wall and actuable to deflect the wall, thereby to effect droplet ejection from an associated channel; the first and second electrodes of each actuator terminating in one or the other of the channels separated by said side wall respectively.

32. Method according to claim 31, wherein the step of providing an apparatus further comprises providing a channel that contains a common termination for electrodes of the two actuators associated with the two channel walls bounding said channel.

It is certified that error appears in the above-identified patent and that said Letters Patent is hereby corrected as shown below:

Column 15, line 52 - Column 20, line 14 (cont'd),

33. Method according to claim 32, further comprising the steps of alternately assigning successive channels of the array to one of two groups and alternately enabling each group for droplet ejection in successive cycles; applying to the common termination in channels belonging to the group that is enabled first voltage signals repeating at a first frequency; and applying to the common terminations of channels belonging to the group that is not enabled second voltage signals in accordance with droplet ejection input data.

34. Method according to claim 33, further comprising the steps of alternately assigning successive channels of an enabled group to first and second sub-groups; applying to the common terminations of channels belonging to said first sub-group a third voltage signal repeating at half said first frequency; applying to the common terminations of channels belonging to said second sub-group a fourth voltage signal also repeating at half said first frequency; said third and fourth voltage signals being in anti-phase.

35. Method according to claim 34, wherein the step of applying said first electrical signals further comprises said first voltage signal comprising a stepwise voltage increase, followed by a stepwise voltage decrease at a time T thereafter, followed by a dwell at zero voltage again for a time T; and wherein the steps of applying said third and fourth voltage signals further comprises said third and fourth voltage signals each comprising a stepwise voltage increase, followed by a stepwise voltage decrease at a time 2T thereafter, followed by a dwell at zero voltage again for a time 2T.

36. Method according to claim 34, wherein the steps of applying said third and fourth voltage signals further comprises said first voltage signal comprising a sawtooth voltage waveform having a period of repetition equal to time T; and wherein said third and fourth voltage signals each comprise a stepwise voltage increase, followed by a stepwise voltage decrease at a time T thereafter, followed by a dwell at zero voltage again for a time T.

37. Method according to claim 1, further comprising the step of applying at least one second signal to said actuator of said first channel during said droplet ejection period.

38. Method according to claim 37, further comprising the step of applying at least one first signal to said actuator of said second channel during said droplet ejection period.

39. Method according to claim 38, wherein the steps of applying said at least one first and second electrical signals result in, during said droplet ejection period, the sum of the number of first signals and the number of second signals applied to said actuator of said first channel corresponds to the sum of the number of said first signals and the number of said second signals applied to said actuator of said second channel.

40. Method according to claim 38, wherein the steps of applying said at least one first and second electrical signals result in the sum of the number of said first signals and the number of said second signals applied to a said chamber is constant for successive droplet ejection periods.

UNITED STATES PATENT AND TRADEMARK OFFICE

CERTIFICATE OF CORRECTION

PATENT NO. : 6,568,779 B1
DATED : May 27, 2003
INVENTOR(S) : Robert M. Pulman et al.

It is certified that error appears in the above-identified patent and that said Letters Patent is hereby corrected as shown below:

Column 15, line 52 - Column 20, line 14 (cont'd),

41. Signal processing means for operating a droplet deposition apparatus comprising first and second chambers each supplied with droplet fluid and communicating with a respective nozzle for ejection of droplets therefrom and each having a respective actuator actuable by electrical signals to vary the volume of that chamber, volume variation sufficient to effect droplet ejection being effected in accordance with droplet ejection input data; said signal processing means being configured to supply to said actuator means of said first chamber a plurality of first electrical signals to effect ejection from the first chamber of a corresponding number of droplets to form a printed dot of appropriate tone on a surface, and supply to said actuator means of said second chamber a number of second electrical signals that do not effect drop ejection from the second chamber, wherein the change in temperature of the droplet fluid in said first chamber caused by the application of said first electrical signals is substantially equal to that in the droplet fluid in said second chamber caused by the application of said second electrical signals.

42. In combination, droplet deposition apparatus comprising first and second chambers each supplied with droplet fluid and communicating with a respective nozzle for ejection of droplets therefrom and having a respective actuator actuable by electrical signals to vary the volume of that chamber, volume variation sufficient to effect droplet ejection being effected in accordance with droplet ejection input data; and signal processing means for applying said electrical signals, said signal processing means being configured to supply to said actuator means of said first chamber a plurality of first electrical signals to effect ejection from the first chamber of a corresponding number of droplets to form a printed dot of appropriate tone on a surface, and supply to said actuator means of said second chamber a number of second electrical signals that do not effect drop ejection from the second chamber, wherein the change in temperature of the droplet fluid in said first chamber caused by the application of said first electrical signals is substantially equal to that in the droplet fluid in said second chamber caused by the application of said second electrical signals.

Signed and Sealed this

Twenty-seventh Day of December, 2005

JON W. DUDAS
*Director of the United States Patent and Trademark Office*